US008248200B2

(12) United States Patent
Ishimoto et al.

(10) Patent No.: US 8,248,200 B2
(45) Date of Patent: Aug. 21, 2012

(54) INDUCTANCE COMPONENT

(75) Inventors: Hitoshi Ishimoto, Hyogo (JP); Nobuya Matsutani, Osaka (JP); Hidenori Uematsu, Osaka (JP); Koji Shimoyama, Hyogo (JP); Michio Ohba, Osaka (JP); Mikio Taoka, Osaka (JP)

(73) Assignee: Panasonic Corporation, Osaka (JP)

( * ) Notice: Subject to any disclaimer, the term of this patent is extended or adjusted under 35 U.S.C. 154(b) by 1044 days.

(21) Appl. No.: 11/909,756

(22) PCT Filed: Mar. 19, 2007

(86) PCT No.: PCT/JP2007/055535

§ 371 (c)(1),
(2), (4) Date: Sep. 26, 2007

(87) PCT Pub. No.: WO2007/119426

PCT Pub. Date: Oct. 25, 2007

(65) Prior Publication Data

US 2010/0182116 A1 Jul. 22, 2010

(30) Foreign Application Priority Data

| | | |
|---|---|---|
| Mar. 24, 2006 | (JP) | 2006-082278 |
| Apr. 17, 2006 | (JP) | 2006-113151 |
| Apr. 17, 2006 | (JP) | 2006-113152 |
| May 10, 2006 | (JP) | 2006-131329 |
| May 12, 2006 | (JP) | 2006-133305 |
| Jun. 30, 2006 | (JP) | 2006-180661 |
| Jun. 30, 2006 | (JP) | 2006-180663 |

(51) Int. Cl.

| | |
|---|---|
| ***H01F 27/29*** | (2006.01) |
| ***H01F 38/12*** | (2006.01) |
| ***H01F 5/00*** | (2006.01) |

(52) U.S. Cl. ..... 336/192; 336/84 M; 336/200

(58) Field of Classification Search ..... 336/192, 336/200, 223, 232, 84 R, 84 M, 84 C See application file for complete search history.

(56) References Cited

U.S. PATENT DOCUMENTS

| | | | | |
|---|---|---|---|---|
| 4,295,112 | A * | 10/1981 | Yamada et al. | 336/84 M |
| 5,396,101 | A * | 3/1995 | Shiga | 257/531 |
| 6,404,317 | B1 * | 6/2002 | Mizoguchi et al. | 336/200 |
| 6,529,720 | B1 * | 3/2003 | Jovenin et al. | 455/318 |
| 6,593,838 | B2 * | 7/2003 | Yue | 336/84 C |
| 6,600,208 | B2 * | 7/2003 | Brennan et al. | 257/531 |
| 6,603,382 | B1 * | 8/2003 | Komai et al. | 336/200 |
| 6,768,409 | B2 * | 7/2004 | Inoue et al. | 336/200 |
| 7,091,816 | B1 * | 8/2006 | Ito et al. | 336/200 |

(Continued)

FOREIGN PATENT DOCUMENTS

| | | |
|---|---|---|
| JP | 4-088608 | 3/1992 |

(Continued)

*Primary Examiner* — Mohamad Musleh
*Assistant Examiner* — Mangtin Lian
(74) *Attorney, Agent, or Firm* — Wenderoth, Lind & Ponack, L.L.P.

(57) ABSTRACT

In an inductance component, a stress is not locally applied even in the condition where heat is applied to entire component, such as when implementing soldering, so that high reliability is realized. For realizing this, the component includes an element, a coil formed in the element, terminals electrically connected to the coil, and magnetic layers arranged so as to be substantially parallel to a winding surface of the coil are formed in the element and the entirety of the magnetic layers is covered with a material of which thermal expansion and contraction rate is uniform.

22 Claims, 23 Drawing Sheets

U.S. PATENT DOCUMENTS

| | | | | |
|---|---|---|---|---|
| 7,247,922 | B2 * | 7/2007 | Yeh et al. | 257/516 |
| 7,403,091 | B2 * | 7/2008 | Ishimoto et al. | 336/234 |
| 2003/0095026 | A1 * | 5/2003 | Kawanobe | 336/200 |
| 2004/0061587 | A1 | 4/2004 | Hong et al. | |
| 2005/0068150 | A1 * | 3/2005 | Matsutani et al. | 336/223 |
| 2006/0145804 | A1 * | 7/2006 | Matsutani et al. | 336/200 |
| 2007/0030108 | A1 * | 2/2007 | Ishimoto et al. | 336/200 |

FOREIGN PATENT DOCUMENTS

| | | |
|---|---|---|
| JP | 4-101403 | 4/1992 |
| JP | 09-055316 | 2/1997 |
| JP | 9-055316 | 2/1997 |
| JP | 2001-155923 | 6/2001 |
| JP | 2003-158017 | 5/2003 |
| JP | 2003-203813 | 7/2003 |
| JP | 2003-203913 | 7/2003 |
| JP | 2003-257744 | 9/2003 |
| JP | 2004-128506 | 4/2004 |
| JP | 2005-317604 | 11/2005 |
| JP | 2005-340586 | 12/2005 |
| JP | 2006-032587 | 2/2006 |
| JP | 2007-123352 | 5/2007 |

* cited by examiner

INDUCTANCE COMPONENT

BACKGROUND OF THE INVENTION

I. Technical Field

The present invention relates to an inductance component used in a power supply circuit of a cellular phone, for example.

II. Description of Related Art

Conventionally, the inductance component of this kind is configured as a chip coil in which coil 2 is formed in sheet-shaped element 1, terminal 3 is electrically connected to coil 2, and magnetic layers 4 are formed on upper and lower surfaces of element 1, as shown in FIG. 23.

By providing insulating covering 20 so as to cover magnetic layer 4 and the entire element 1, electric connection with the other components is prevented.

As a conventional art document regarding the present application, Unexamined Japanese Patent Publication No. 2006-32587 is known, for example.

However, such a conventional inductance component has a problem that reliability thereof is low.

That is, in the above-described conventional configuration, stress is locally applied to the magnetic layer 4 by heat when implementing soldering or the like, from a difference in the thermal expansion and contraction rates between element 1 and insulating body 5, and as a result, the reliability is low.

SUMMARY OF THE INVENTION

An object of the present invention is to improve the reliability of an inductance component having a magnetic layer.

In order to achieve the object, the present invention includes an element, a coil formed in the element, and a terminal electrically connected to the coil, wherein a plurality of magnetic layers arranged substantially in parallel to a winding surface of the coil in the element are formed in the element, thereby constituting an inductance component.

Since the inductance component according to the present invention is configured to form the magnetic layer in the element, the entire magnetic layer is covered with a material of which the thermal expansion and contraction rate is uniform, so that a stress is not locally applied to the magnetic body even in the condition where heat is applied over the entire component, such as when implementing soldering or the like, thereby achieving high reliability.

According to another aspect of the present invention, the inductance component is preferably provided with a plurality of magnetic layers, and a portion of the element is interposed between the plurality of magnetic layers. According to this aspect of the invention, it becomes possible to increase the saturation magnetic flux, and at the same time, even when the thermal expansion rate between the element and the magnetic layers, as well as between the magnetic layers, is different, the magnetic layers are not detached from the element, and high reliability is realized.

According to still another aspect of the present invention, the inductance component is preferably formed such that at least a portion of the terminal is formed of the magnetic body. With this configuration, it becomes possible to improve magnetic permeability without increasing an area of the inductance component itself, or to decrease an occupation area of the coil, and as a result, the inductance value may be improved.

According to yet another aspect of the present invention, the inductance component is preferably formed such that a slit is formed on the magnetic layer and the slit is filled with a portion of the element. With this configuration, stress is not locally applied to the magnetic body even in the condition where heat is applied to the entire component, such as when implementing soldering, and high reliability can be realized.

According to yet another aspect of the present invention, the inductance component is preferably formed such that a plurality of substantially V-shaped slits, spreading from a bending portion thereof in an outer peripheral direction of the magnetic layer, are arranged in parallel on the magnetic layer. With this configuration, generation of an eddy current may be greatly prevented at an outer peripheral portion of the magnetic layer.

According to yet another aspect of the present invention, the inductance component is preferably formed such that a plurality of substantially V-shaped slits, spreading from a bending portion thereof in an outer peripheral direction of the magnetic layer, are arranged in parallel at least on an inner square portion of the magnetic layer, and a radial slit extending from a central direction to an outer peripheral direction of the magnetic layer is formed on an outer square portion of the magnetic layer. According to this aspect of the invention, it becomes possible to make a space between the slits on the inner square portion of the magnetic layer through which a magnetic flux passes, most of which may be made to be uniform, thereby greatly preventing the generation of an eddy current.

According to yet another aspect of the present invention, the inductance component is preferably formed such that a through-hole portion is provided on the element in an inner peripheral direction of the coil, a center core magnetic layer is provided within the through-hole portion, and an insulating wall substantially perpendicular to the winding surface of the coil is provided on the center core magnetic layer. With this configuration, it becomes possible to reduce the generation of the eddy current without lowering the magnetic permeability of the center core magnetic layer itself, so that the inductance value can be improved.

DETAILED DESCRIPTION OF THE INVENTION

First Embodiment

Figure 1:
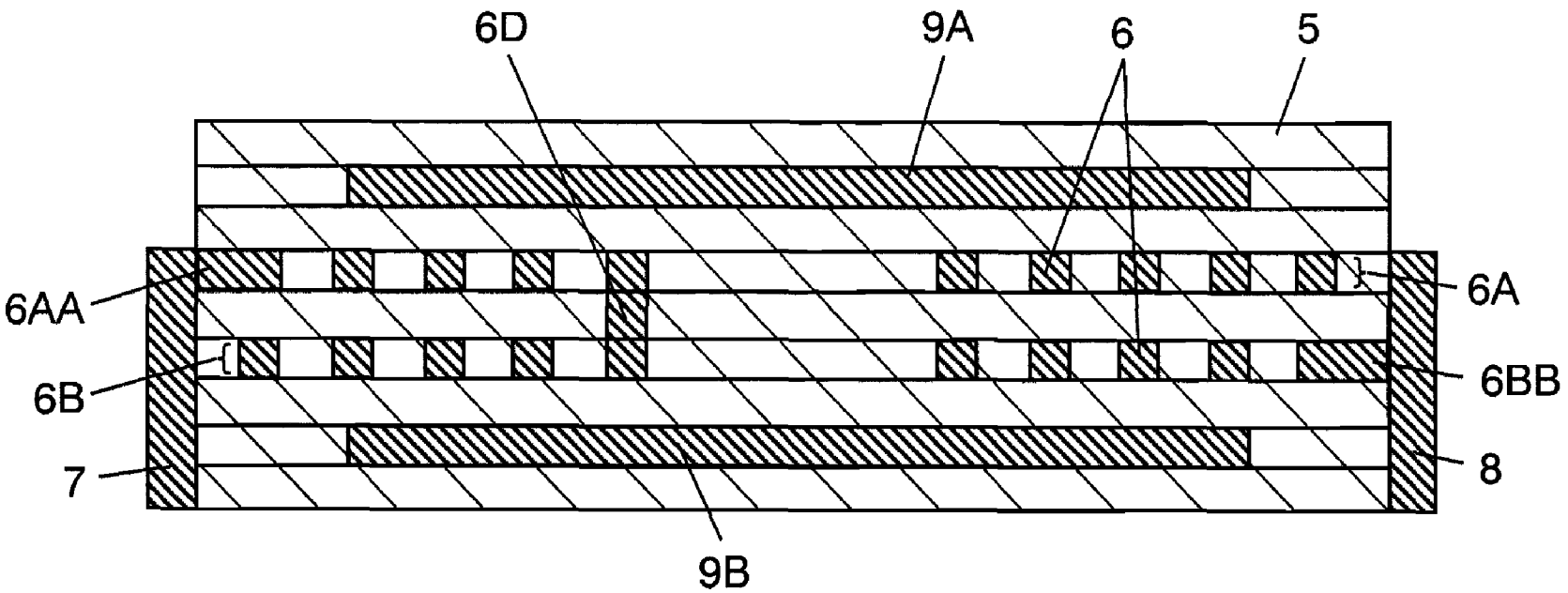
FIG. 1 is a cross-sectional view of an inductance component according to a first embodiment of the present invention.
Figure 2:
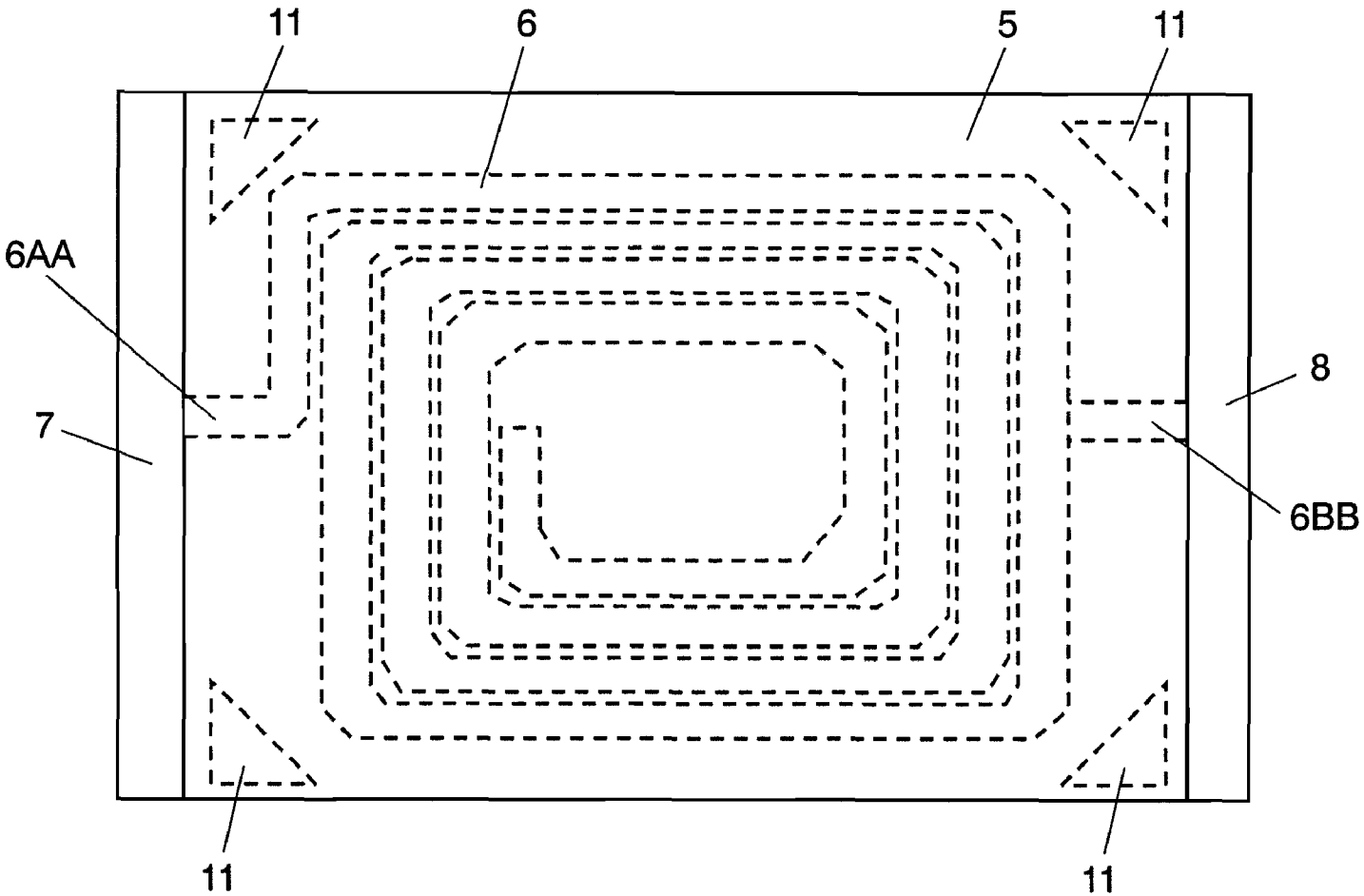
FIG. 2 is a top view of the inductance component according to the first embodiment of the present invention.
Figure 3:
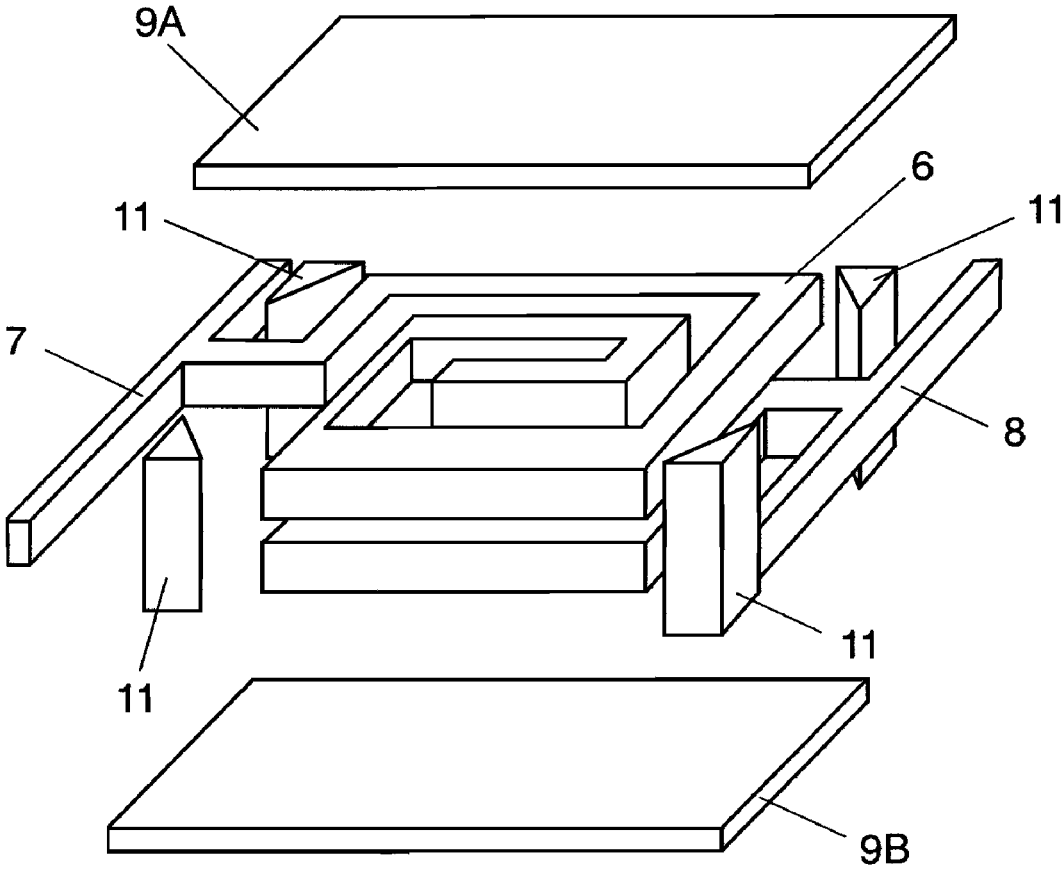
FIG. 3 is an exploded perspective view of the inductance component according to the first embodiment of the present invention.

Hereinafter, an inductance component according to a first embodiment of the present invention is described with reference to FIG. 1 showing a cross-sectional view of the inductance component according to the first embodiment of the present invention, FIG. 2 showing a top view of the inductance component and FIG. 3 showing an exploded perspective view of the inductance component.

In FIG. 1, coil 6 is formed in sheet-shaped element 5, and terminals 7 and 8 are formed on an outer side of this coil 6, as shown in FIG. 2. As shown in FIG. 1, via 6D is formed between planar coils 6A and 6B, which form coil 6, in element 5, and magnetic layers 9A and 9B are formed on upper and lower sides of coil 6, respectively, in element 5.

Here, magnetic layers 9A and 9B are arranged so as to be substantially parallel to a winding surface of coil 6. This is in order to arrange magnetic layers 9A and 9B having high magnetic permeability in the path of a magnetic flux generated from coil 6.

Here, although coil 6 may be of one layer, in the present embodiment, the coil 6 is composed of two layers of planar coils 6A and 6B. Upper planar coil 6A is wound from terminal 7 in an inner peripheral direction so as to form a spiral, an innermost peripheral portion of this planar coil 6A and an innermost peripheral portion of lower planer coil 6B are connected by means of via 6D, and this planar coil 6B is wound in a direction toward terminal 8 (outer peripheral direction) so as to form a spiral, thereby forming coil 6.

Here, it is preferable that planar coils 6A and 6B are wound in the same direction. This is in order to realize a large inductance value without causing the magnetic flux generated in planar coil 6A and the magnetic flux generated in planar coil 6B to negate each other.

Here, a thickness of each magnetic layer 9A and 9B is less than twice the skin depth (skin effect thickness) in order to prevent generation of an eddy current.

Meanwhile, in order to improve an inductance value, outer core 11 formed of a magnetic body is provided on the outer side of coil 6 to thicken magnetic coupling between upper magnetic layer 9A and lower magnetic layer 9B.

In this manner, by configuring such that each of magnetic layers 9A and 9B is formed in element 5, that is, by configuring such that each of the entire magnetic layers 9A and 9B is covered with element 5 of which thermal expansion and contraction rate is uniform, stress is not locally applied to magnetic layers 9A and 9B, even in the situation where heat is applied to the entire component, such as when implementing soldering, so that high reliability can be obtained.

Additionally, by providing magnetic layers 9A and 9B, the inductance component of which the inductance value is high can be realized.

In the present embodiment, although it is configured such that one magnetic layer 9A and one magnetic layer 9B are arranged on the upper side and on the lower side of coil 6, respectively, by constituting with one or more layers, it is possible to improve a saturation magnetic flux density, and at the same time, it is possible to obtain a high inductance value. Also, the number of magnetic layers to be formed may be different on the upper and lower sides of coil 6. However, the inductance value lowers when there exists a portion through which the magnetic flux hardly flows on either of the upper and lower sides of coil 6, so that it is preferred that the same number of layers are arranged on the upper and lower sides of coil 6 when the magnetic layers of the same thickness are used, and that the layers are arranged such that a total thickness of the layers are the same on the upper and lower sides of coil 6 when the magnetic layers having different thicknesses are used.

Although a cross section of coil 6 may be a circle and not a square, the square is preferred because this allows a coil sectional area to be taken larger than that of the circle, and it is possible to reduce copper loss.

It is preferred that the thickness of each planar coil 6A and 6B be not less than 10 μm to cope with a high current.

It is preferred to use a metal magnetic material containing Fe or Fe alloy as magnetic layers 9A and 9B, from the viewpoint of magnetic flux density and magnetic loss. When Fe alloy is used for magnetic layers 9A and 9B, it is preferred that a composition ratio of Fe is not less than 30 percent by mass. This is because improvement of a magnetic characteristic of a high saturation magnetic flux density and a low coercivity may be realized by making the content of Fe contained in magnetic layers 9A and 9B not less than 30 percent by mass. Also, by making the content of nickel about 80%, high magnetic permeability is obtained, and it becomes possible to obtain a large inductance value.

As the Fe alloy used for magnetic layers 9A and 9B, the metal magnetic material containing either of FeNi, FeNiCo and FeCo is more preferable from the viewpoint of high magnetic flux density and low magnetic loss.

For fabricating magnetic layers 9A and 9B, an electroplating method may be used, for example.

At this time, a plating bath used in the electroplating process is prepared to contain an Fe ion or other metal ion.

Meanwhile, as additives in the plating bath, it is preferred to put a stress-relaxing agent, a pit preventative and a complexing agent. The stress-relaxing agent includes saccharin, for example. The saccharin is a substance containing sulfonate, so that this may exert its effect. By putting such a stress-relaxing agent, it becomes possible to form magnetic layers 9A and 9B having excellent uniformity in which a crack will hardly occur even when magnetic layers 9A and 9B are formed to be thick. For example, when saccharin is used as the stress-relaxing agent, the effect thereof is produced by preparing the plating bath to contain 0.1 to 5 g/L of saccharin; however, a volume with which a stress-relaxing effect is exerted varies depending on a plating condition such as a current density, so that this is controllable by appropriately setting conditions.

By preparing the plating bath to contain, as the complexing agent, an organic molecule such as an amino acid, a monocarboxylic acid, a dicarboxylic acid and a tricarboxylic acid, and an inorganic molecule, for stabilizing a variety of metal ions, a complex stabilized with the metal ion may be formed.

Although an Fe-alloy film is formed by a general electrolytic plating method by using such a plating bath, by devising a method in which the plating is performed in a plating device in which a positive electrode is separated or in a magnetic field, it becomes possible to form the Fe-alloy film having excellent magnetic characteristics.

Figure 4:
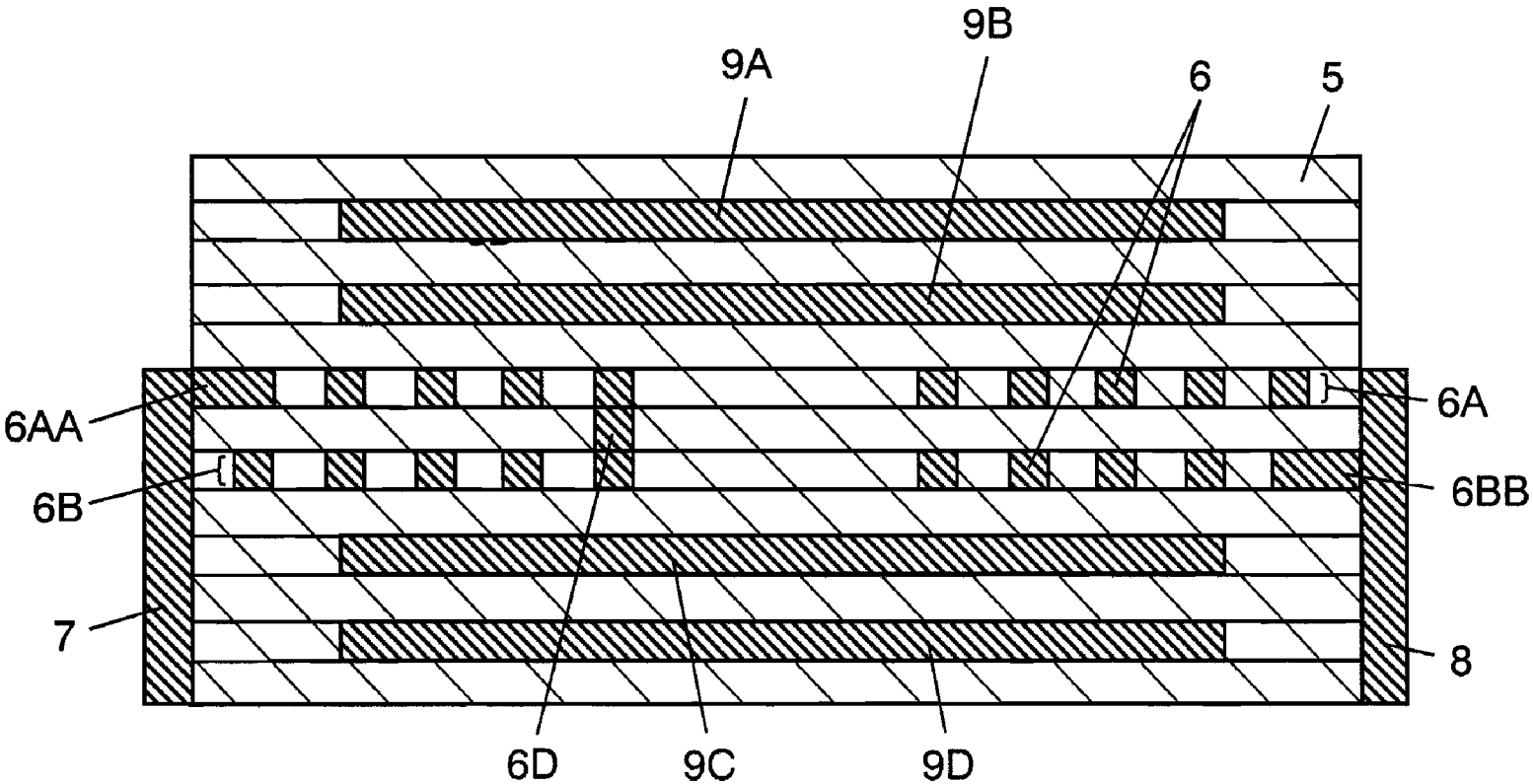
FIG. 4 is a cross-sectional view showing an example in which a magnetic layer is increased in the first embodiment of the present invention.

A cross sectional view of an example in which the magnetic layer is increased is shown in FIG. 4. The same reference numerals are assigned to the same components as those in FIG. 1, and descriptions thereof are omitted. In FIG. 4, a plurality of magnetic layers 9A and 9B and a plurality of magnetic layers 9C and 9D are formed on the upper and lower sides of coil 6, in element 5. It is configured such that a portion of element 5 is interposed between each magnetic layers 9A, 9B, 9C and 9D in a plurality of magnetic layers.

A plurality of magnetic layers 9A, 9B, 9C and 9D are arranged so as to be substantially parallel to the winding surface of coil 6. This is in order to arrange magnetic layers 9A, 9B, 9C and 9D having high magnetic permeability in the path of the magnetic flux.

The thickness of each of magnetic layers 9A, 9B, 9C and 9D is made less than twice the skin depth, in order to prevent generation of an eddy current.

In this manner, since it is configured such that each of the plurality of magnetic layers 9A, 9B, 9C and 9D is formed in element 5, that is, such that each of the entirety of magnetic layers 9A, 9B, 9C and 9D is covered with element 5, even though the thermal expansion and contraction rates are different between magnetic layers 9A, 9B, 9C and 9D, or between element 5 and magnetic layers 9A, 9B, 9C and 9D, magnetic layers 9A, 9B, 9C and 9D are not detached from element 5, so that it is possible to obtain high reliability.

Further, by forming element 5 abutting on each magnetic layer 9A, 9B, 9C and 9D of a material of which thermal expansion and contraction rate is uniform, the stress generated by a difference in the thermal expansion and contraction rates between magnetic layers 9A, 9B, 9C and 9D and element 5 is uniformly applied to each of entire magnetic layers 9A, 9B, 9C and 9D, so that deterioration in reliability by force locally applied between magnetic layers 9A, 9B, 9C and 9D and element 5 may be prevented.

Further, since it is configured such that a portion of element 5 is interposed between each of magnetic layers 9A, 9B, 9C and 9D, the eddy current in each of magnetic layers 9A, 9B, 9C and 9D may be prevented.

Further, since a plurality of magnetic layers 9A, 9B, 9C and 9D are provided, a saturation magnetic flux increases in proportion to the number of layers, and it becomes possible to realize an excellent DC current superimpose characteristic, and at the same time, realize a high inductance value.

Meanwhile, in the present embodiment, although it is configured such that two magnetic layers 9A and 9B are arranged on the upper side of coil 6 and two magnetic layers 9C and 9D are arranged on the lower side of coil 6, respectively, a higher magnetic flux saturation density and inductance value may be obtained by arranging two or more layers. Although the number of the magnetic layers to be arranged may be different between the upper and lower sides of coil 6, it is preferable that the same number of layers are arranged on the upper and lower sides of coil 6 when using the magnetic layers having the same thickness, and that the total thickness of the magnetic layers are the same on the upper and lower sides of coil 6 when using the magnetic layers having different thicknesses, since the inductance value deteriorates when there exists a portion through which the magnetic flux hardly flows on either of the upper and lower sides.

Second Embodiment

Figure 5:
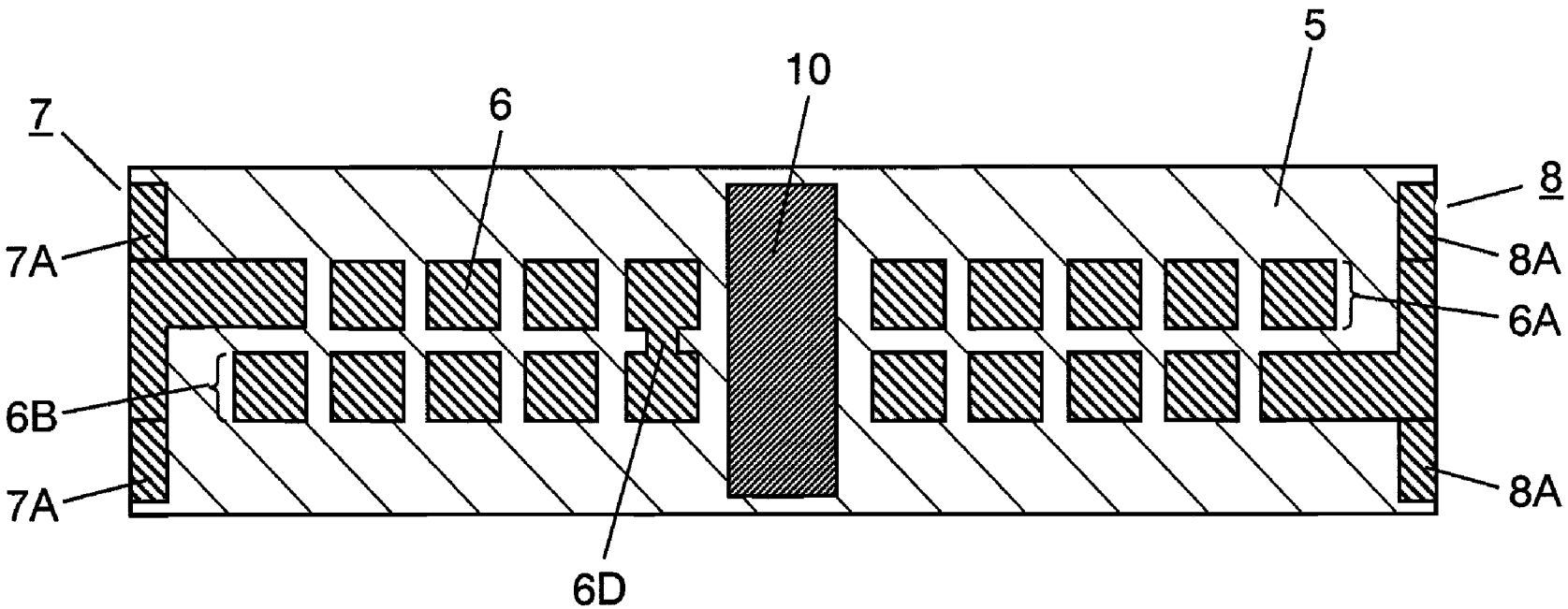
FIG. 5 is a cross-sectional view of an inductance component according to a second embodiment of the present invention.

Next, an inductance component according to a second embodiment of the present invention is described with reference to the drawings. FIG. 5 is a cross-sectional view of the inductance component according to the second embodiment of the present invention.

In FIG. 5, coil 6 is formed in sheet-shaped element 5, terminals 7 and 8 are formed on an outer portion of this coil 6, and via 6D is formed between planar coils 6A and 6B, which form coil 6, in element 5. Portions of terminals 7 and 8 are formed of magnetic terminals 7A and 8A formed of a magnetic body.

Here, it is preferred that a metal magnetic material containing Fe or an Fe-alloy is used as a material of magnetic terminals 7A and 8A from the viewpoint of magnetic flux density and magnetic loss. In the case where Fe-alloy is used as magnetic terminals 7A and 8A, it is preferred to make the composition ratio of Fe not less than 30 percent by mass. This is because the magnetic characteristic of high saturation magnetic flux density as well as low coercivity may be realized by making Fe content in magnetic terminals 7A and 8A not less than 30 percent by mass. By making a content of nickel about 80%, high magnetic permeability may be obtained, and large inductance value may thus be obtained, which is preferable.

As the Fe-alloy used for magnetic terminals 7A and 8A, it is more preferable that the metal magnetic material containing either of FeNi, FeNiCo and FeCo is used, from the view of the high magnetic flux density and the low magnetic loss.

For fabricating these magnetic terminals 7A and 8A, an electroplating method may be used, for example.

Here, although coil 6 may be of one layer, in the second embodiment, coil 6 is composed of two layers of planar coils 6A and 6B. Upper planar coil 6A is wound from terminal 7 in the inner peripheral direction so as to form a spiral, the innermost portion of this planar coil 6A and the innermost portion of lower planar coil 6B are connected by means of via 6D, and this planar coil 6B is wound in the direction toward terminal 8 (outer peripheral direction) so as to make a spiral, thereby forming coil 6.

In this manner, since at least portions of terminals 7 and 8 are formed of magnetic terminals 7A and 8A, the magnetic permeability thereof may be improved, and as a result, the inductance value may be improved.

Further, since magnetic terminals 7A and 8A are provided within areas originally occupied by terminals 7 and 8, it is not necessary to increase the area of the inductance component itself, or to decrease the occupying area of coil 6.

Meanwhile, by forming magnetic center core 10 made of a magnetic body on an inner portion of coil 6 in element 5, a higher inductance value may be obtained.

Figure 6:
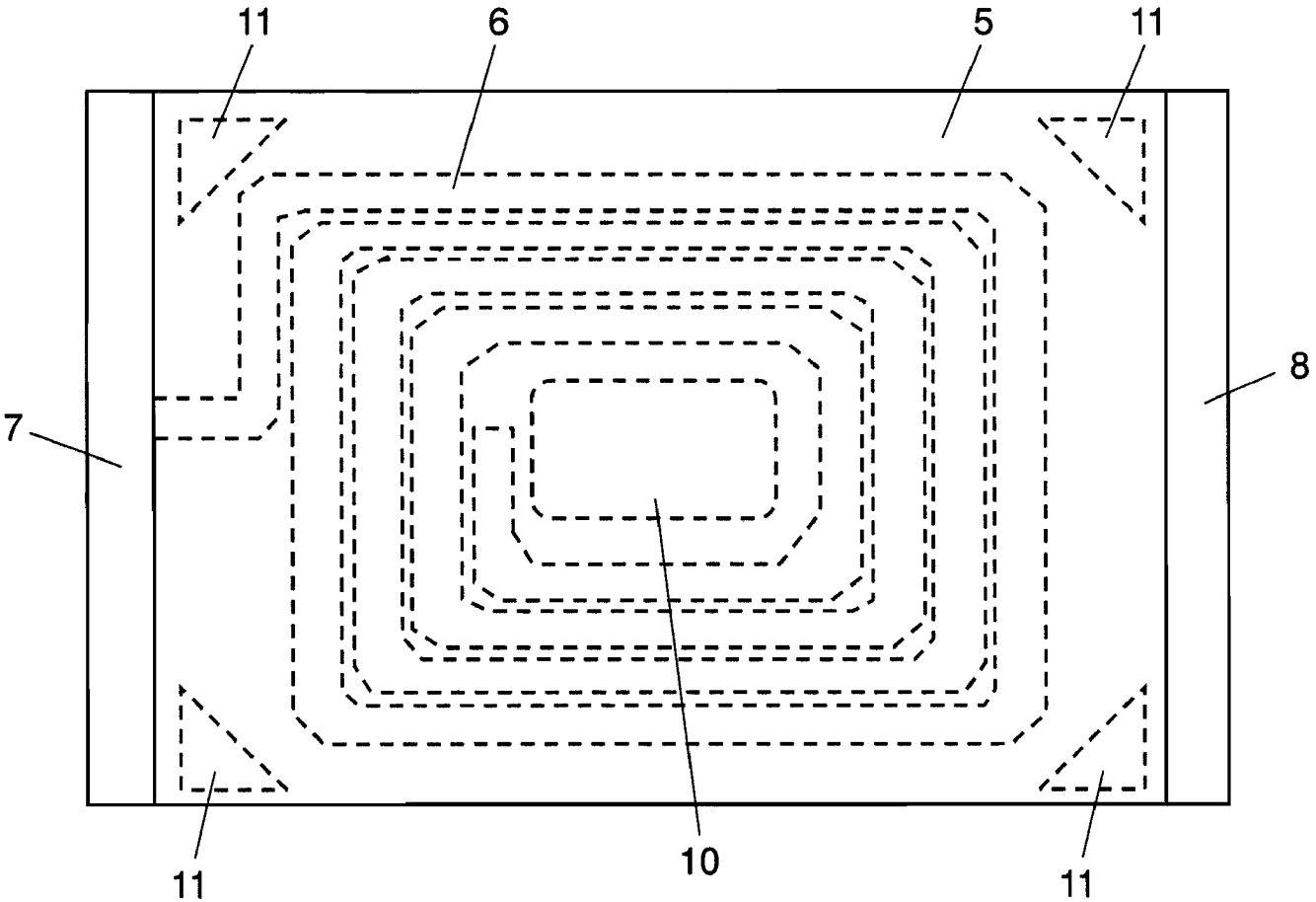
FIG. 6 is a top view of the inductance component according to the second embodiment of the present invention.

FIG. 6 is a top view of the inductance component according to the second embodiment of the present invention. As shown in FIG. 6, by further forming magnetic outer core 11 formed of a magnetic body on an outer portion of coil 6 in element 5, a higher inductance value may be obtained. In this manner, it becomes possible to cope with high current, which is preferable.

Herein, magnetic center core 10 is formed at least of a mixture of magnetic powder and a resin. As the magnetic powder, ferrite powder or metal magnetic powder mainly containing Fe, Ni or Co may be used.

Meanwhile, although it is possible to form magnetic center core 10 using the metal magnetic body and an oxide magnetic body, when forming the same of the mixture of the magnetic powder and the resin, a resistance value within magnetic center core 10 can be increased, and the generation of the eddy current can be prevented, which is preferable.

Specifically, although the magnetic power having soft magnetic properties, such as MnZn ferrite powder, NiZn ferrite powder, MgZn ferrite powder, hexagonal ferrite powder, garnet-type ferrite powder, Fe powder, Fe—Si-based alloy powder, Fe—Si—Al-based alloy powder, Fe—Ni-based alloy powder, Fe—Co-based alloy powder, Fe—Mo—Ni-based alloy powder, Fe—Cr—Si-based alloy powder, and Fe—Si—B-based alloy powder, may be used, it is more preferable to use particularly a magnetic powder of which saturation magnetic flux density is high, such as Fe—Ni-based alloy powder, Fe—Co-based alloy powder and Fe—Mo—Ni-based alloy powder.

In a case in which the metal magnetic powder is used as the magnetic powder, a particle diameter thereof is preferably not less than 0.5 μm and not more than 100 μm, and more preferably not less than 2 μm and not more than 30 μm. When the particle diameter is too large, an eddy-current loss becomes too large at higher frequencies, on the other hand, when the particle diameter is too small, required amount of resin becomes large and the magnetic permeability deteriorates.

Although the resin having a binding property may be used as the resin to form magnetic center core 10, it is preferable that a thermosetting resin such as an epoxy resin, a phenol resin, a silicon resin, a polyimide resin or the like, from the viewpoint of strength after binding and heat resistance when using. In order to improve dispersibility with the magnetic body powder and resin performance, a minute amount of dispersant and plasticizer or the like may be added. Further, in order to adjust viscosity of the paste before hardening, or in order to improve an insulation property when using the metal magnetic powder, it is preferred to add a third component. Such a third component includes a silane coupling agent, a titanium coupling agent, a titanium alkoxide, water, glass, boron nitride, talc, mica, barium sulfate, tetrafluoroethylene, and the like.

Third Embodiment

Figure 7:
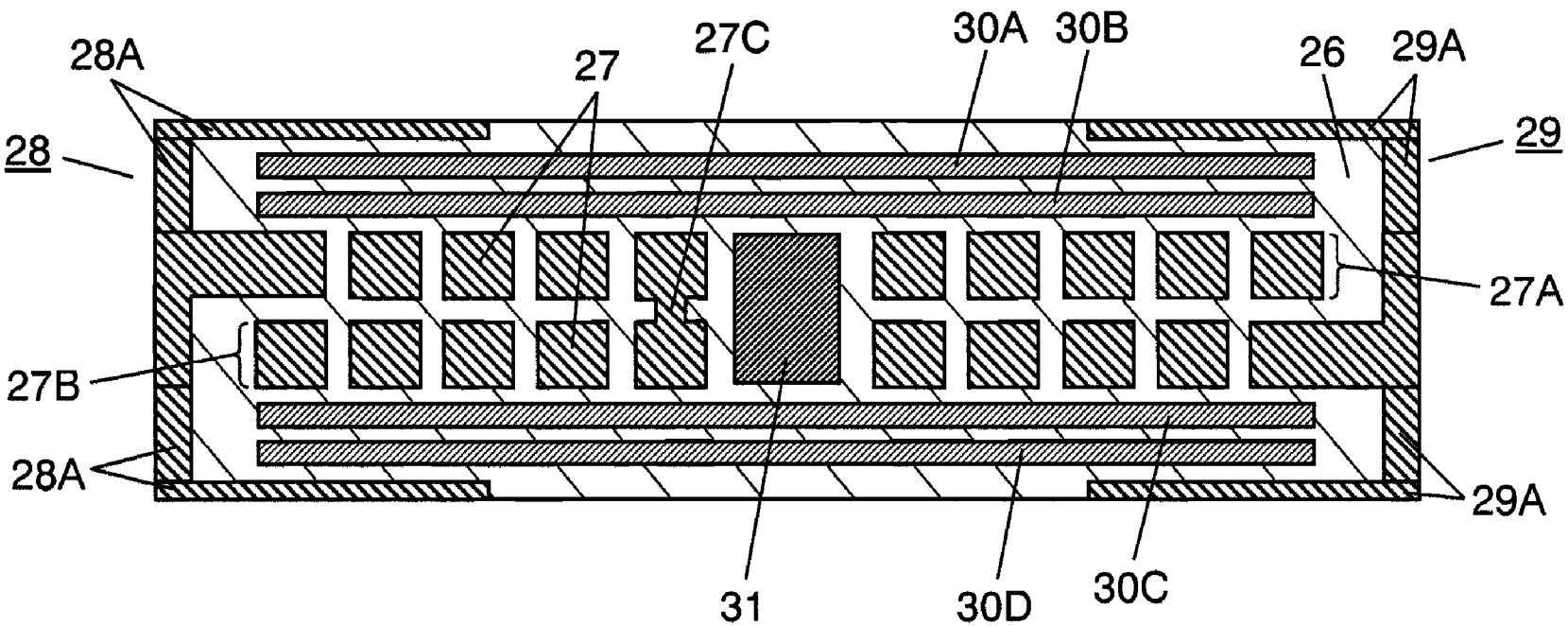
FIG. 7 is a cross-sectional view of an inductance component according to a third embodiment of the present invention.

Hereinafter, an inductance component according to a third embodiment of the present invention is described with reference to the drawings. FIG. 7 is a cross-sectional view of the inductance component according to the third embodiment of the present invention.

In FIG. 7, coil 27 is formed in sheet-shaped element 26, terminals 28 and 29 are formed on outermost peripheral portions of this coil 27, and via 27C is formed between planar coils 27A and 27B, which form coil 27, in element 26.

Magnetic layers 30A and 30B, and 30C and 30D are formed on upper and lower sides of coil 27 in element 26, respectively.

Portions of terminals 28 and 29 are formed of magnetic terminals 28A and 29A formed of a magnetic body.

Further, in the present embodiment, magnetic terminals 28A and 29A in terminals 28 and 29 are formed also on the upper and lower surfaces of element 26.

On an inner portion of coil 27 in element 26, magnetic center core 31 formed of a magnetic body is formed.

In this manner, since at least portions of terminals 28 and 29 are formed of magnetic terminals 28A and 29A, the magnetic permeability thereof can be improved, and as a result, the inductance value may be improved.

By arranging magnetic terminals 28A and 29A and magnetic layers 30A and 30B, and 30C and 30D on the upper and lower sides of coil 27, respectively, most of a pathway through which the magnetic flux emitted from magnetic center core 31 enters magnetic center core 31 again may be composed only of a material having high magnetic permeability, so that the inductance value may be further improved.

Further, since magnetic layers 28A and 29A are provided within an area originally occupied by terminals 28 and 29, it is not necessary to increase the area of the inductance component itself, or to reduce an occupying area of coil 27.

Further, by forming a magnetic outer core (not shown) formed of a magnetic body on an outer portion of coil 27 in element 26, a higher inductance value may be obtained.

Fourth Embodiment

Figure 8:
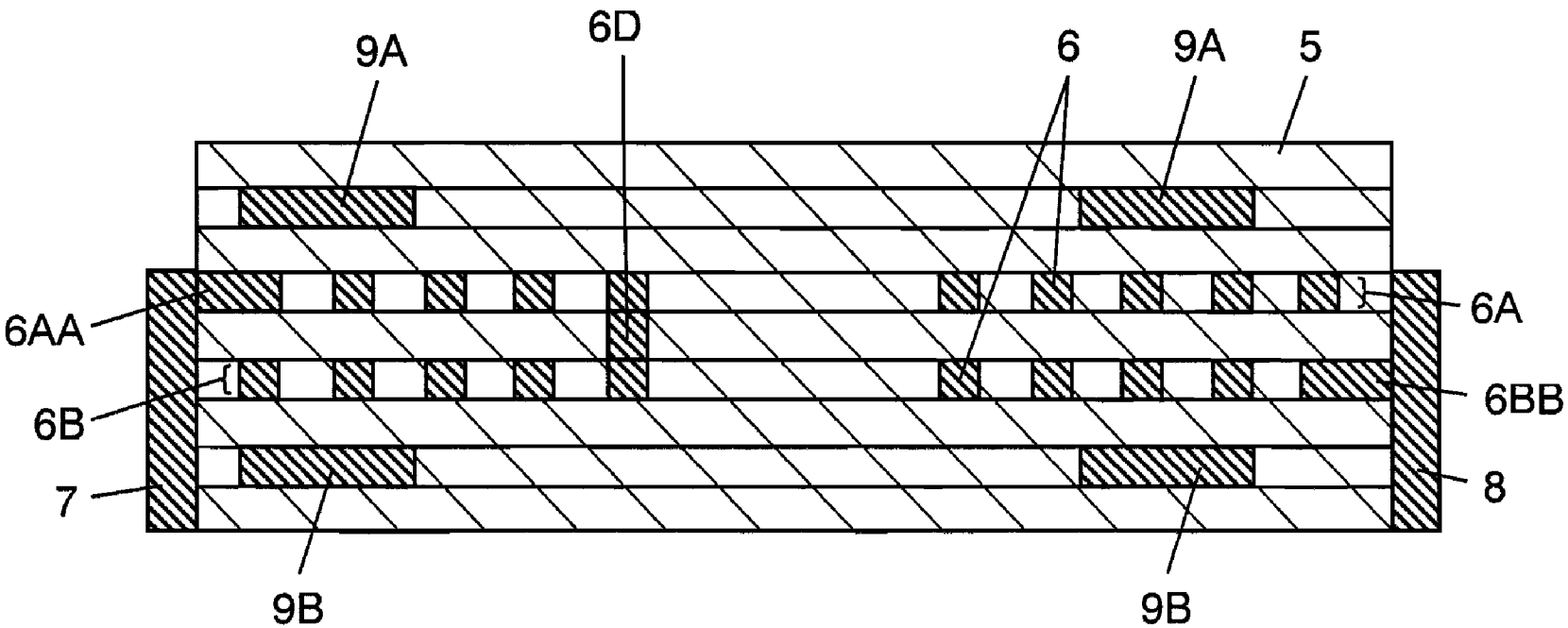
FIG. 8 is a cross-sectional view of an inductance component according to a fourth embodiment of the present invention.
Figure 9:
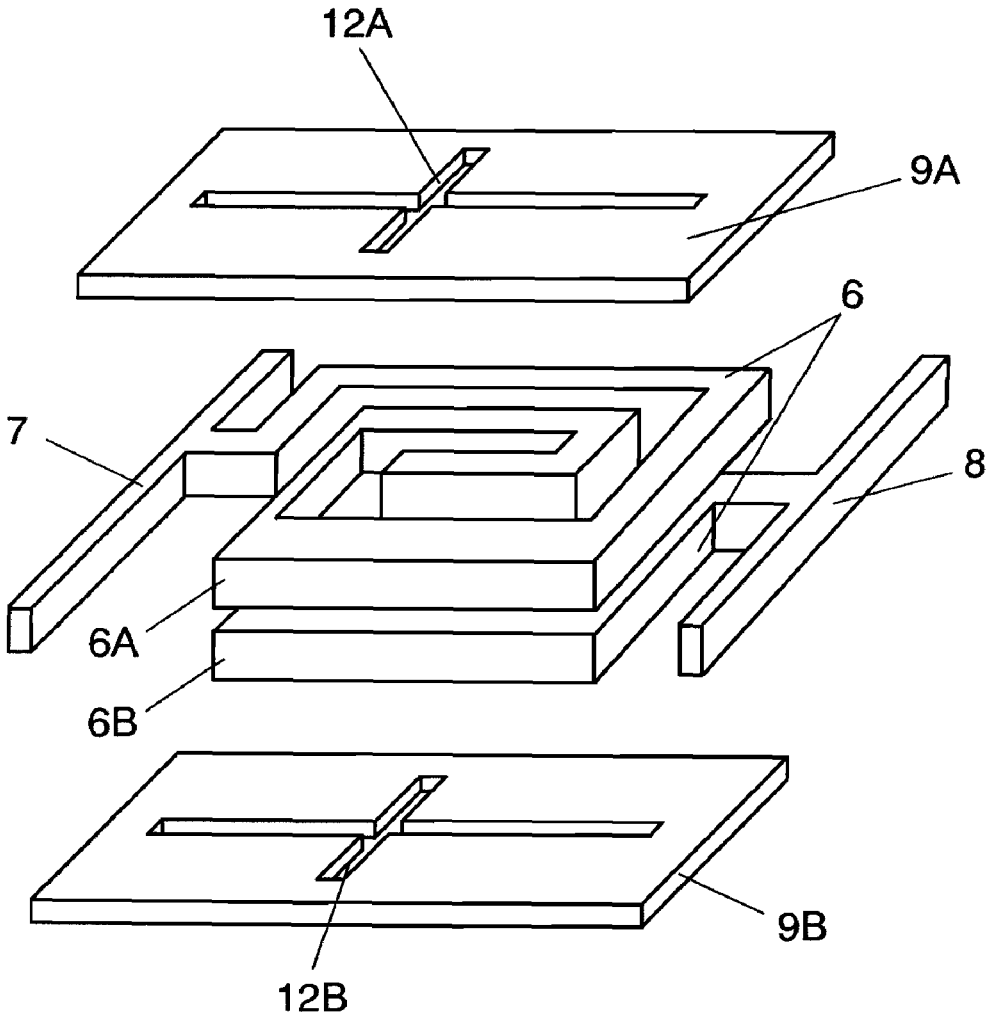
FIG. 9 is an exploded perspective view of the inductance component according to the fourth embodiment of the present invention.

FIG. 8 shows a cross-sectional view of an inductance component according to a fourth embodiment of the present invention. FIG. 9 shows an exploded perspective view of the inductance component. The same reference numerals are assigned to the same components as those in FIGS. 1 and 2, and detailed descriptions thereof are omitted.

Slits 12A and 12B are formed on magnetic layers 9A and 9B as shown in FIG. 9, and these slits 12A and 12B are filled with a portion of element 5 shown in FIG. 8.

Here, it is preferred that magnetic layers 9A and 9B are arranged so as to be substantially parallel to the winding surface of coil 6. This is in order to arrange magnetic layers 9A and 9B having high magnetic permeability in the path of the magnetic flux generated from coil 6.

In this manner, since it is configured such that each of magnetic layers 9A and 9B is formed in element 6 and slits 12A and 12B provided on magnetic layers 9A and 9B are filled with a portion of element 5, each of entire magnetic layers 9A and 9B may be covered with element 5 of which thermal expansion and contraction rate is uniform, so that the stress is not locally applied to magnetic layers 9A and 9B even in the condition where heat is applied to the entire component, such as when implementing soldering, and it becomes possible to obtain the high reliability.

By providing slits 12A and 12B, it becomes possible to prevent the generation of the eddy current in magnetic layers 9A and 9B.

A form of slits 12A and 12B includes a cross shape as shown in FIG. 9, a form radially extending from a center portion, and the like. By forming slits 12A and 12B radially extend from the center portion, a percentage of an area commanded by slits 12A and 12B in magnetic layers 9A and 9B becomes large in a central portion through which the magnetic flux pass the most, that is, in which the eddy current most likely to be generated, so that it becomes possible to effectively prevent the eddy current, which is preferable.

Further, by providing slits 12A and 12B and by filling slits 12A and 12B with a portion of element 5, a contact area between magnetic layers 9A and 9B and element 5 may be increased, thereby making adhesiveness thereof higher.

By configuring such that planar coils 6A and 6B are wound on the same surface, a short inductance component can be realized.

Meanwhile, in the present embodiment, although one magnetic layer 9A and one magnetic layer 9A are arranged on the upper and lower sides of coil 6, respectively, a higher inductance value may be obtained by arranging one or more layers.

Fifth Embodiment

Figure 10:
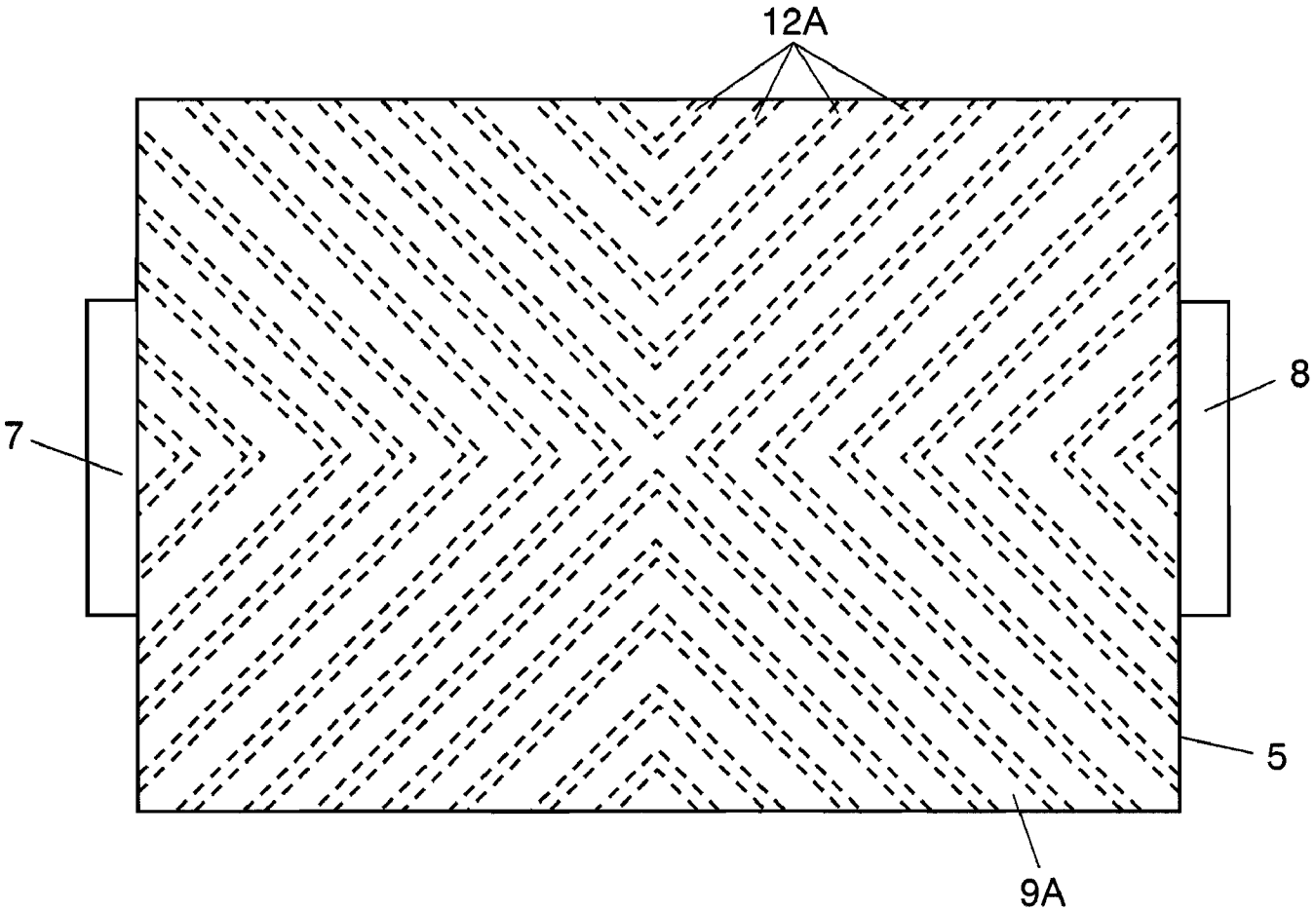
FIG. 10 is a plan view showing a form of a slit to be formed in a magnetic layer in a fifth embodiment of the present invention.
Figure 11:
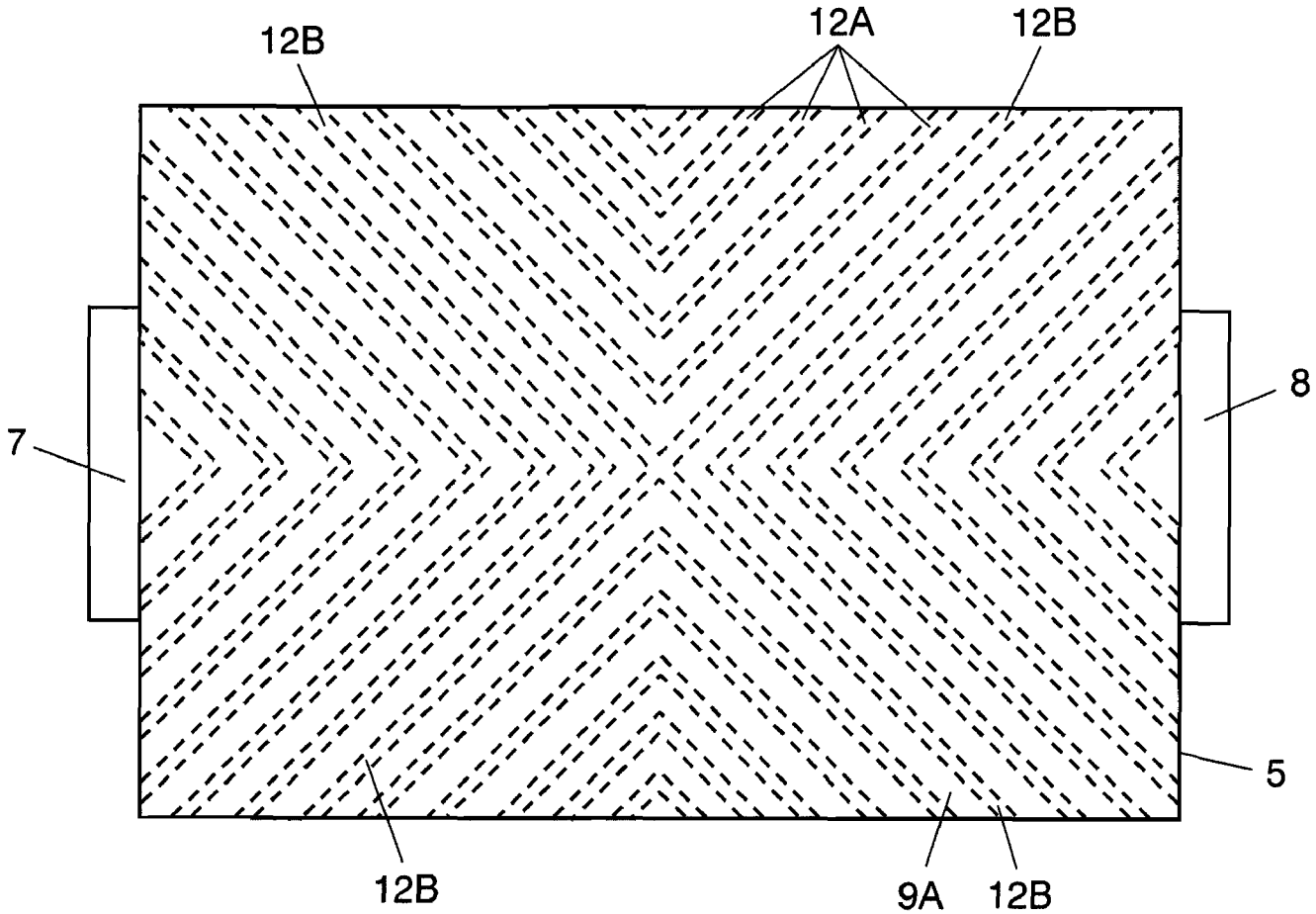
FIG. 11 is a plan view showing another form of the slit to be formed in the magnetic layer in the fifth embodiment of the present invention.
Figure 12:
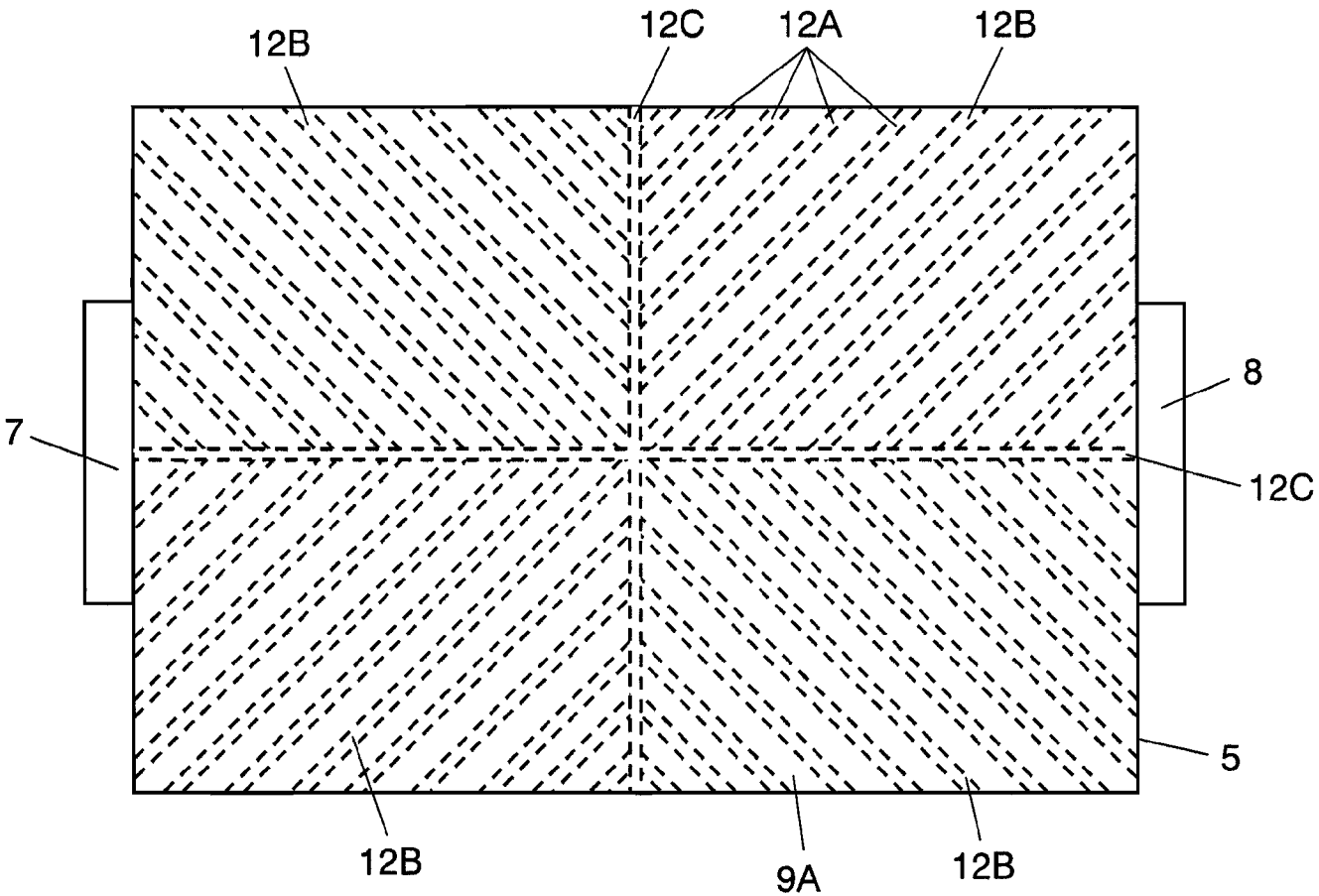
FIG. 12 is a plan view showing yet another form of the slit to be formed in the magnetic layer in the fifth embodiment of the present invention.

In a fifth embodiment, the embodiment of an inductance component provided with a slit form effective to prevent the eddy current in the magnetic layer is shown. FIGS. 10 to 12 are plan views illustrating the slit form formed on the magnetic layer in the fifth embodiment. The cross-sectional view and the exploded perspective view are substantially the same as those of the first embodiment, so that they are omitted.

On magnetic layers 9A and 9B, a plurality of substantially V-shaped slits 12A, spreading from a bent portion thereof in an outer peripheral direction of magnetic layers 9A and 9B, are formed in parallel to one another, as shown in FIG. 10.

A space between substantially V-shaped slits 12A as shown in FIG. 10 is made less than twice the skin depth in order to prevent the generation of the eddy current in a direction of a plane on which magnetic layers 9A and 9B are formed.

In this manner, since it is configured such that the plurality of substantially V-shaped slits 12A, spreading from the bending portion thereof in the outer peripheral direction of magnetic layers 9A and 9B, are formed in parallel to one another on magnetic layers 9A and 9B, as shown in FIG. 10, it becomes possible to make the space between slits 12A uniform in a central portion and an outer peripheral portion of magnetic layers 9A and 9B, thereby greatly preventing the generation of the eddy current in the vicinity of the outer peripheral portion of magnetic layers 9A and 9B.

Further, by configuring such that substantially V-shaped slits 12A spreads from the bending portion in the outer peripheral direction thereof, divergence of the magnetic flux, which is generated from the central portion of coil 6, from the bending portion in the outer peripheral direction through magnetic layers 9A and 9B is hardly prevented by the existence of slits 12A shown in FIG. 10, and it is possible to obtain the high inductance value.

Further, by a configuration as shown in FIG. 11, that is, by the configuration in which a plurality of substantially V-shaped slits 12A are formed in parallel to substantially cross-shaped slits 12B, the eddy current in the central portion of entire magnetic layer 9A may further be reduced.

Further, by configuring as shown in FIG. 12, that is, by configuring such that a plurality of substantially V-shaped slits 12A are formed in parallel to substantially cross-shaped slit 12B and that slit 12C intersecting the bending portion of the plurality of substantially V-shaped slits 12A is provided, the eddy current in the central portion (V-shaped bending portion) in magnetic layer 9A formed between the plurality of substantially V-shaped slits 12A can further be reduced.

Meanwhile, the form and the arrangement of the slits in magnetic layers 9A and 9B is preferably the same. This is because, if there is a portion through which the magnetic flux hardly passes, the inductance value is limited by the portion.

Although it is possible to configure such that magnetic layers 9A and 9B are formed not in element 5 but on the upper or lower surface thereof, it is possible to configure such that an entirety of each magnetic layer 9A and 9B is covered with element 5 of which thermal expansion and contraction rate is uniform, by forming magnetic layers 9A and 9B in element 5 and by filling slits 12A and 12B provided on these magnetic layers 9A and 9B with a portion of element 5. With this configuration, the stress is not locally applied to magnetic layers 9A and 9B even in the condition where heat is applied to the entire coil component, such as when implementing soldering, thereby obtaining the high reliability.

Further, by providing slits 12A and 12B and by filling slits 12A and 12B with a portion of element 5, a contact area between magnetic layers 9A and 9B and element 5 increases, thereby increasing adhesiveness therebetween.

It is preferred, in FIGS. 10 to 12, to form the bending portions of the plurality of V-shaped slits 12A on a position corresponding to the central portion of coil 6 in magnetic layers 9A and 9B. This is because when the magnetic flux generated from the central portion of coil 6 emanates in the outer peripheral direction of magnetic layers 9A and 9B, prevention of the magnetic flux by the existence of slits 12A is limited at minimum.

Sixth Embodiment

Figure 13:
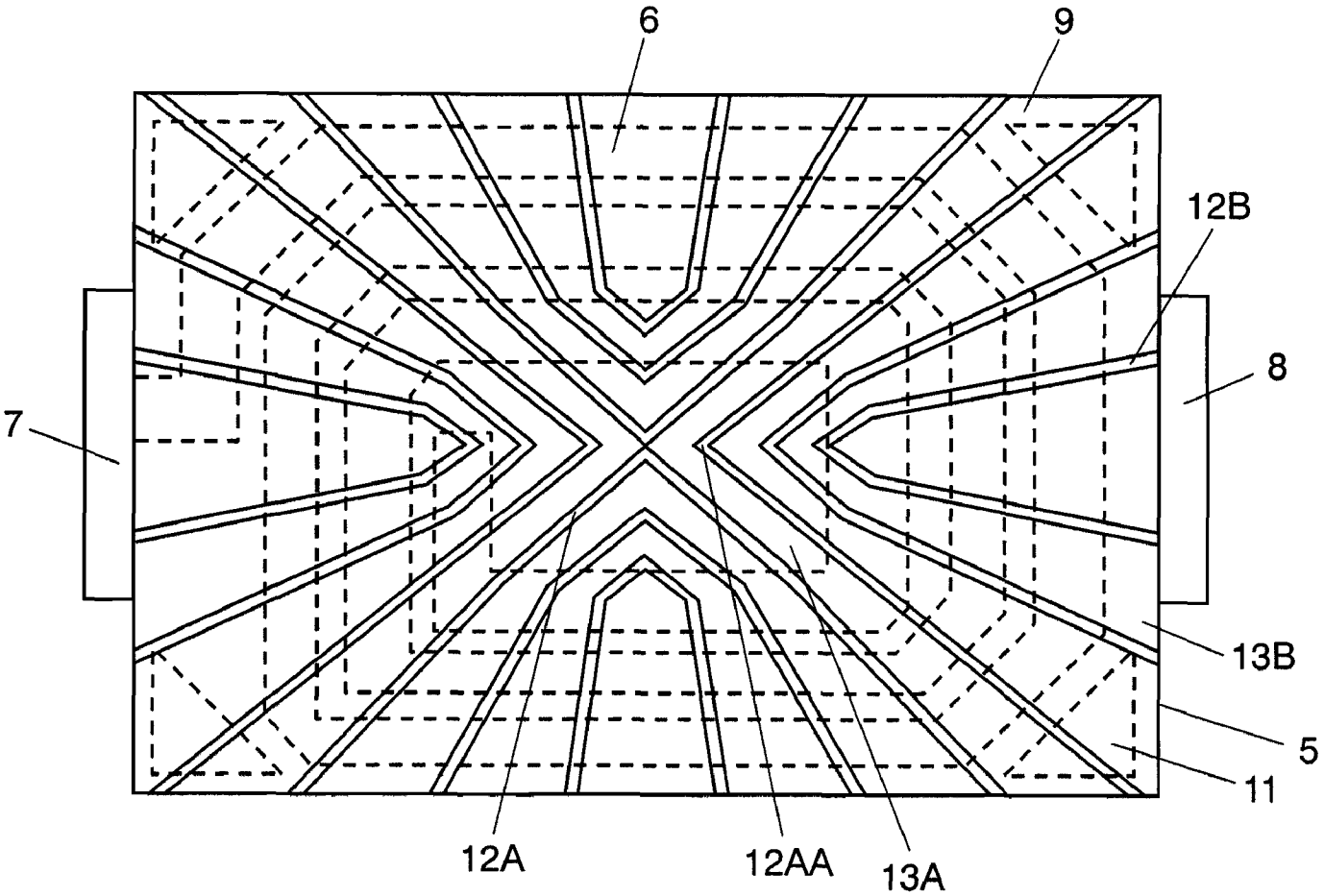
FIG. 13 is a plan view showing a form of a slit to be formed in a magnetic layer in a sixth embodiment of the present invention.

In a sixth embodiment, an inductance component provided with a slit form, which is effective to further prevent the eddy current in the magnetic layer, is shown. FIG. 13 is a plan view illustrating forms of slits 12A and 12B to be formed in magnetic layer 9. The cross-sectional view thereof is not shown since this is the same as FIG. 1, described in the first embodiment.

As shown in FIG. 13, on inner square portion 13A in magnetic layer 9, a plurality of substantially V-shaped slits 12A, extending from a bending portion 12AA thereof in the outer peripheral direction of magnetic layer 9 are formed in parallel to one another.

Here, in a case where outer core 11 made of a magnetic material is formed in the outer peripheral direction of coil 6 in element 5, it is preferable that one end of substantially V-shaped slit 12A is formed so as to face and extend up to outer core 11. This is in order not to prevent the magnetic flux generated from the central portion of coil 6 from flowing from inner square portion 13A to outer core 11 of magnetic layer 9 by substantially V-shaped slits 12A. As a result, the high inductance value may be obtained.

Radial slit 12B is formed so as to extend from the central portion in the outer peripheral direction of magnetic layer 9 on outer square portion 13B of magnetic layer 9.

Here, the term "inner square portion 13A in magnetic layer 9" refers to a region on which the magnetic flux especially concentrates, and which includes at least an inner portion of the innermost periphery of coil 6. The term "outer square portion 13B in magnetic layer 9" refers to an outer portion of the inner square portion.

Here, it is preferable that one end of substantially V-shaped slit 12A and one end of radial slit 12B are connected in a boundary portion of inner square portion 13A and outer square potion 13B. By configuring such that the magnetic flux flowing between substantially V-shaped slits 12A directly flows between radial slits 12B, it becomes possible to reduce the interruption of the magnetic flux flow by radial slits 12B, and the inductance value may be improved as a result.

Although a plurality of substantially V-shaped slits 12A, which spread from bending portion 12AA in the outer peripheral direction of magnetic layer 9, may be formed over the entire magnetic layer 9 so as to be parallel to one another, since the volume of the magnetic flux flowing per unit area is smaller in magnetic layer outer square portion 13B, a need to consider the eddy current is less than that in inner square portion 13A. Therefore, it is preferred that radial slit 12B is formed so as to extend from the central direction to the outer peripheral direction of magnetic layer 9, instead of substantially V-shaped slits 12A, on outer square portion 13B. This is because the inductance value may be improved without preventing the magnetic flux flow, by daringly to sparsely arrange the space between the slits on outer square portion 13B of magnetic layer 9.

In this manner, since it is configured such that a plurality of substantially V-shaped slits 12A, spreading from bending portion 12AA in the outer peripheral direction of magnetic layer 9, are formed in parallel to one another as shown in FIG. 13, at least in inner square portion 13A of magnetic layer 9, the space between the slits in inner square portion 13A of magnetic layer 9 into which the largest volume of magnetic flux flows may be made uniform, and as a result, the generation of the eddy current may be greatly prevented.

Further, by configuring such that substantially V-shaped slits 12A are formed so as to spread from bending portion 12AA in the outer peripheral direction, divergence of the magnetic flux, generated from the central portion of coil 6, from bending portion 12AA in the outer peripheral direction through magnetic layer 9 shown in FIG. 13 is hardly prevented by the existence of slits 12A shown in FIG. 13, so that it becomes possible to obtain the high inductance value.

Meanwhile, it is preferred that the space between substantially V-shaped slits 12A shown in FIG. 13 is made less than twice the skin depth, so as to prevent the generation of the eddy current in a direction of a plane on which magnetic layer 9 is formed.

Meanwhile, although it is possible to configure such that magnetic layer 9 is formed not in element 5 but on the upper or lower surface thereof, by configuring such that magnetic layer 9 is formed in element 5 and that slit 12 provided on magnetic layer 9 is filled with a portion of element 5, it becomes possible to configure such that the entirety of each magnetic layer 9 is covered with element 5 of which thermal expansion and contraction rate is uniform, so that even in the condition where heat is applied on the entire coil component, such as when implementing soldering, the stress is not applied locally to magnetic layer 9, and it becomes possible to obtain the high reliability.

Further, by configuring such that slit 12 is filled with a portion of element 5, the contact area between the magnetic layer 9 and element 5 increases, thereby increasing the adhesiveness therebetween.

Meanwhile, it is preferred that bending portion 12AA of the plurality of substantially V-shaped slits 12A is formed at the position corresponding to the central portion of coil 6 in magnetic layer 9, in FIG. 13. This is in order to prevent the existence of substantially V-shaped slits 12A from interrupting the divergence of the magnetic flux, when the magnetic flux generated from the central portion of coil 6 emanates in the outer peripheral direction of magnetic layer 9. As a result, a larger inductance value can be obtained.

Seventh Embodiment

Figure 14:
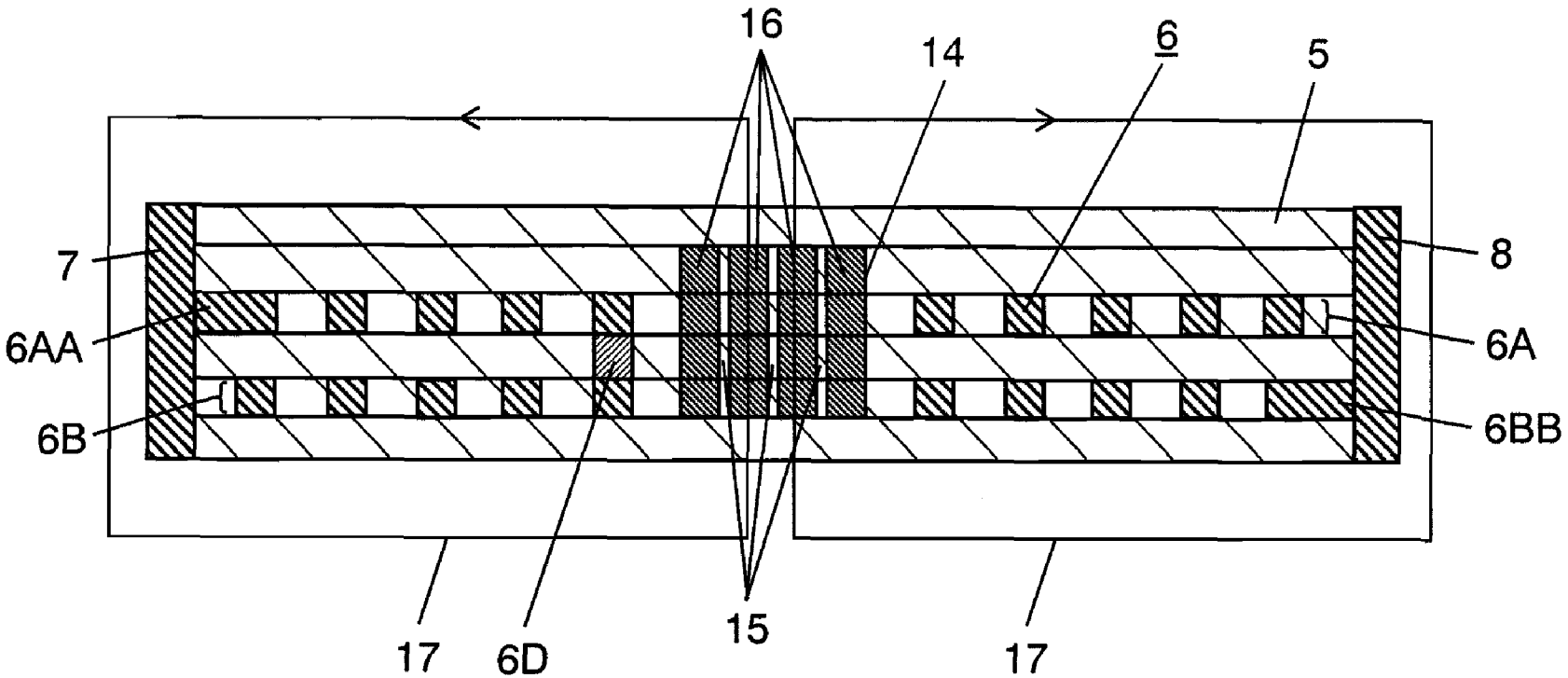
FIG. 14 is a cross-sectional view of an inductance component according to a seventh embodiment of the present invention.

In a seventh embodiment, an embodiment (chip coil) obtained by improving an inductance component having a center core is described with reference to FIG. 14 showing a cross-sectional view and FIGS. 15 to 22 showing top views.

In FIG. 14, through-hole portion 14 is provided on a substantial center of sheet-shaped element 5, coil 6 is formed on an outer portion of through-hole portion 14, coil drawing portions 6AA and 6BB are formed on an outermost peripheral portion of coil 6, via 6D is formed between planar coils 6A and 6B, which form coil 6, in element 5, and center core magnetic layer 16 is formed within through-hole portion 14. Coil drawing portions 6AA and 6BB are electrically connected to terminals 7 and 8 provided on an outer side surface of element 5, respectively.

Between center core magnetic layers 16, a plurality of insulating walls 15 are provided so as to be substantially perpendicular to the winding surface of coil 6. As for an arrangement of walls 15, they are arranged so as to be parallel to one another, when seen from a direction perpendicular to the winding surface of coil 6, as shown in FIG. 15, for example.

By such a configuration, the generation of the eddy current may be efficiently reduced by insulating walls 15, which are substantially perpendicular to the winding surface of coil 6 (that is to say, substantially perpendicular to a surface on which the eddy current generates), and it is not necessary to lower the magnetic permeability of center core magnetic layer 16 itself by adding a material having low magnetic permeability, such as an oxide, so that a preventing effect on circulation of magnetic flux 17 passing through through-hole portion 14 can be reduced, as shown in FIG. 14, and as a result, an inductance component (chip coil) having the high inductance value may be realized.

Figure 16:
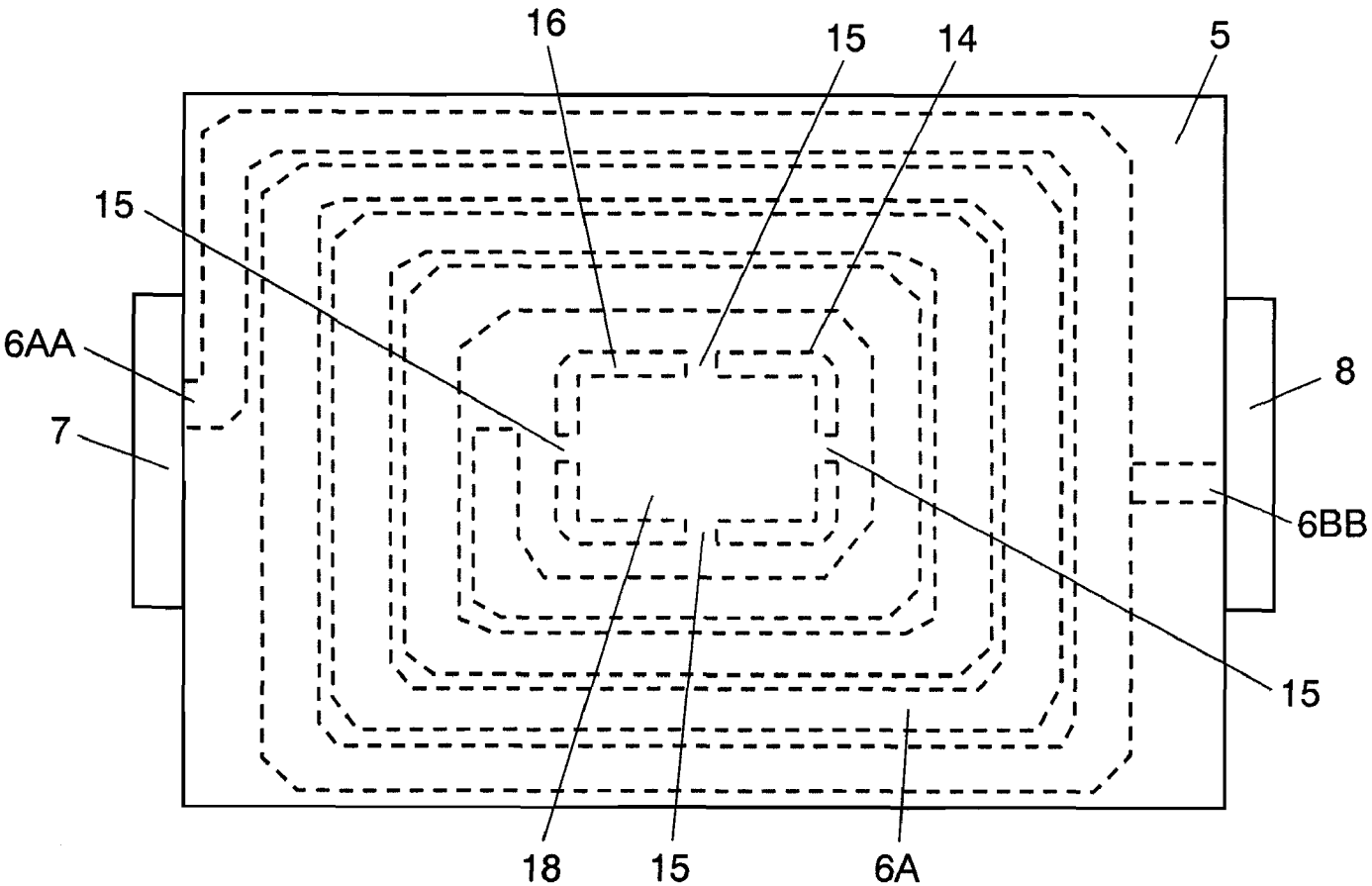
FIG. 16 is a top view of yet another inductance component according to the seventh embodiment of the present invention.

Meanwhile, as for the arrangement of insulating walls 15, by configuring as shown in FIG. 16, that is, by configuring such that center core magnetic layer 16 is formed only on the inner peripheral surface of through-hole portion 14, insulating portion 18 is formed on an inner side thereof, and the plurality of insulating walls 15 substantially perpendicular to the winding surface of coil 6 are provided within center core magnetic layer 16, the generation of the eddy current may be reduced without lowering the magnetic permeability of center core magnetic layer 16 itself.

Figure 15:
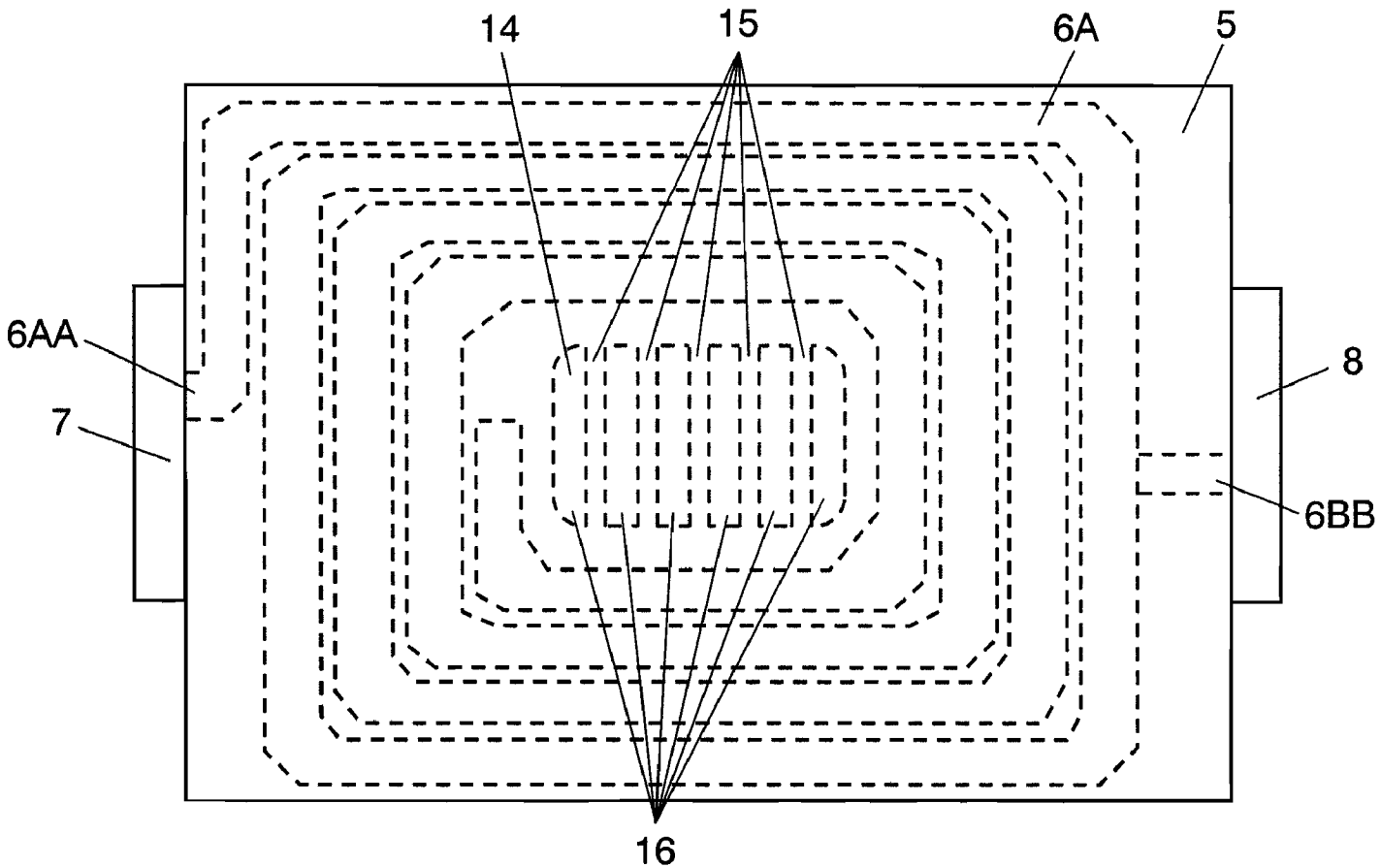
FIG. 15 is a top view of another inductance component according to the seventh embodiment of the present invention.

However, as shown in FIG. 15, by forming center core magnetic layer 16 such that not only the inner peripheral surface of through-hole portion 14 but also the inner side thereof are filled therewith, it becomes possible to increase an effective cross-sectional area of center core magnetic layer 16, and as a result, a saturation magnetic flux density may be preferably increased.

Figure 17:
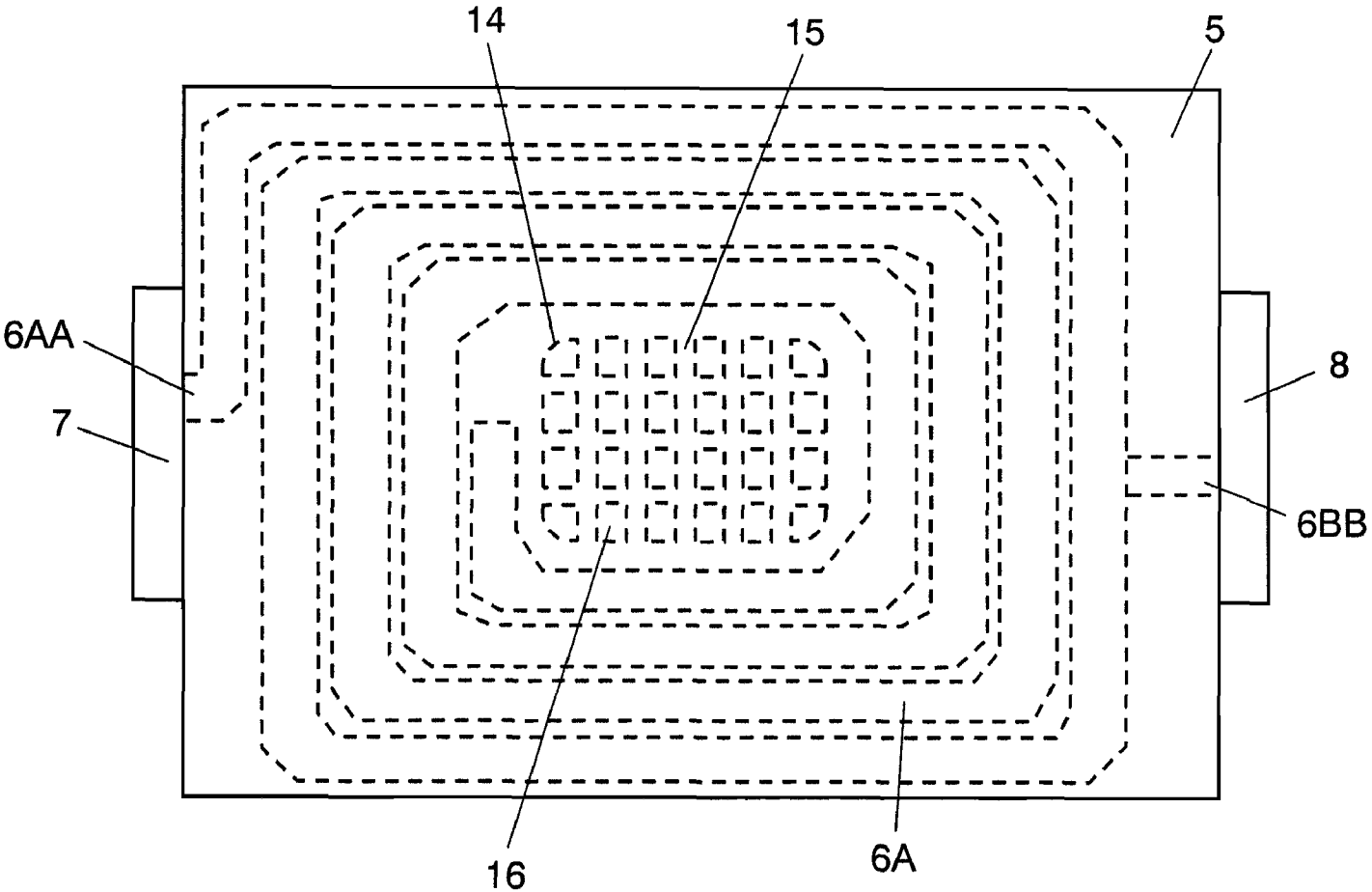
FIG. 17 is a top view of yet another inductance component according to the seventh embodiment of the present invention.

Further, as shown in FIG. 17, by arranging walls 15 so as to be lattice-shaped as seen from a direction perpendicular to the winding surface of coil 6, the eddy current, which is generated by the magnetic flux, may be reduced, for the magnetic flux radially emanating from inside of through-hole portion 14 or entering from four directions into through-hole portion 14. That is, in the configuration shown in FIG. 15, for the magnetic flux entering (emanating) one wall 15 from the perpendicular oblique direction, a distance between wall 15 and another wall 15 adjacent thereto becomes longer on a plane perpendicular to the magnetic flux due to the oblique entering (emanating), so that the eddy current easily generates. However, since it is configured such that walls 15 are provided in a lattice-shape in the configuration shown in FIG. 17, for the magnetic flux entering (emanating) in the perpendicular oblique direction to one wall 15 also, two walls 15 perpendicular to this wall 15 exist so as to be parallel to each other on both sides of the magnetic flux, so that the distance between wall 15 and another wall 15 adjacent to each other on the plane perpendicular to the magnetic flux is constant regardless the entering angle, thereby reducing probability of the eddy current generation. As a result, the generation of the eddy current can be further reduced.

Figure 18:
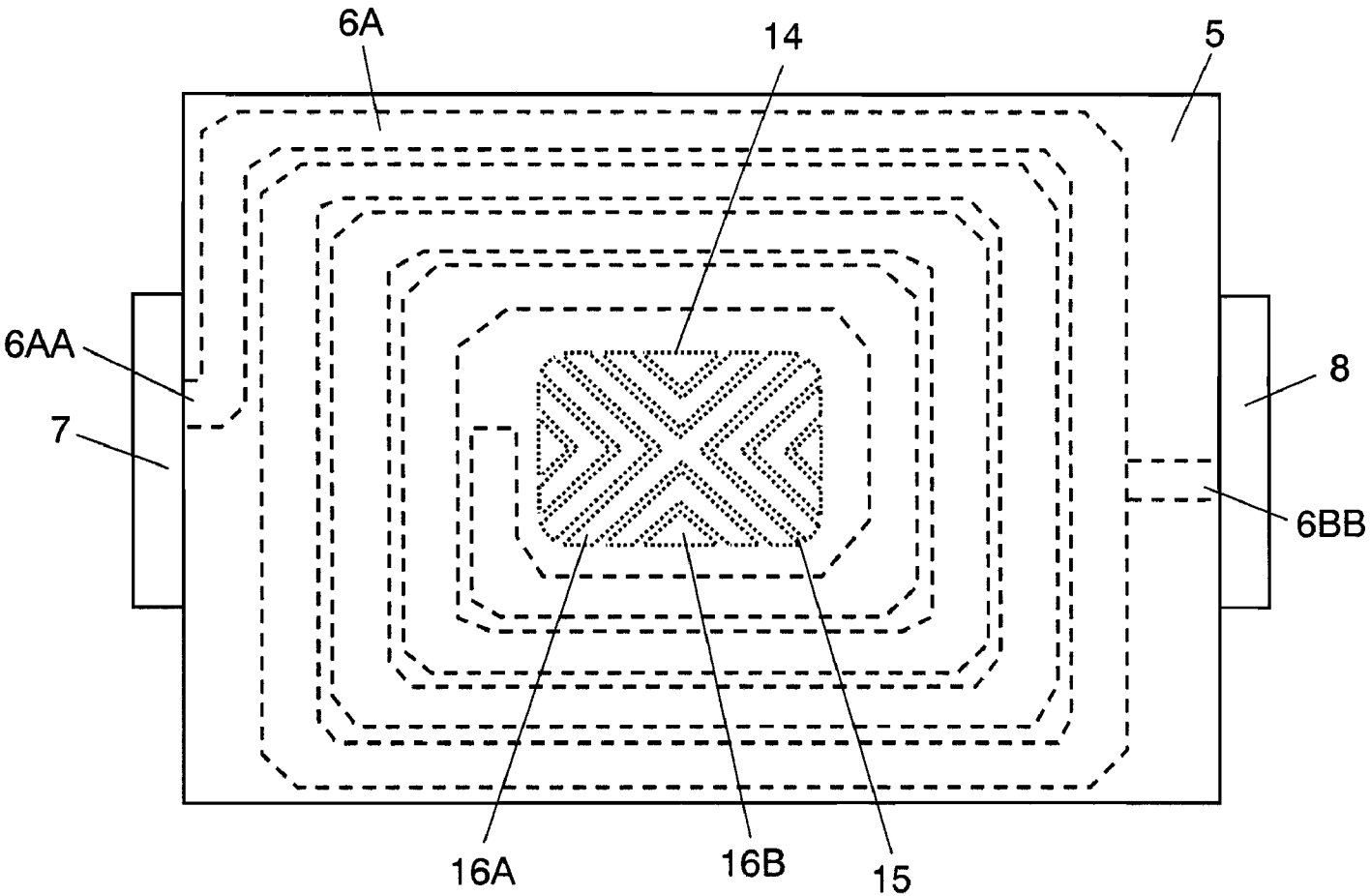
FIG. 18 is a top view of yet another inductance component according to the seventh embodiment of the present invention.

Moreover, by configuring as shown in FIG. 18, that is, by configuring such that a plurality of substantially V-shaped walls 15 are arranged in parallel to substantially cross-shaped magnetic layer 16A, and substantially V-shaped magnetic layer 16B is provided between the plurality of substantially V-shaped walls 15, the inductance value may be improved compared to the configuration shown in FIG. 15. That is to say, with the configuration as shown in FIG. 15, for the magnetic flux in a direction parallel to wall 15 among the magnetic flux emanating (entering) in the upper surface (lower surface) direction of element 5 from through-hole portion 14, the flow thereof is not prevented by the existence of wall 15, however for the magnetic flux in other directions the flow thereof is prevented by wall 15. On the other hand, by configuring as shown in FIG. 18, for the magnetic flux emanating in (entering from) the four directions, walls 15 do not prevent the flow, thereby improving the inductance value.

Figure 19:
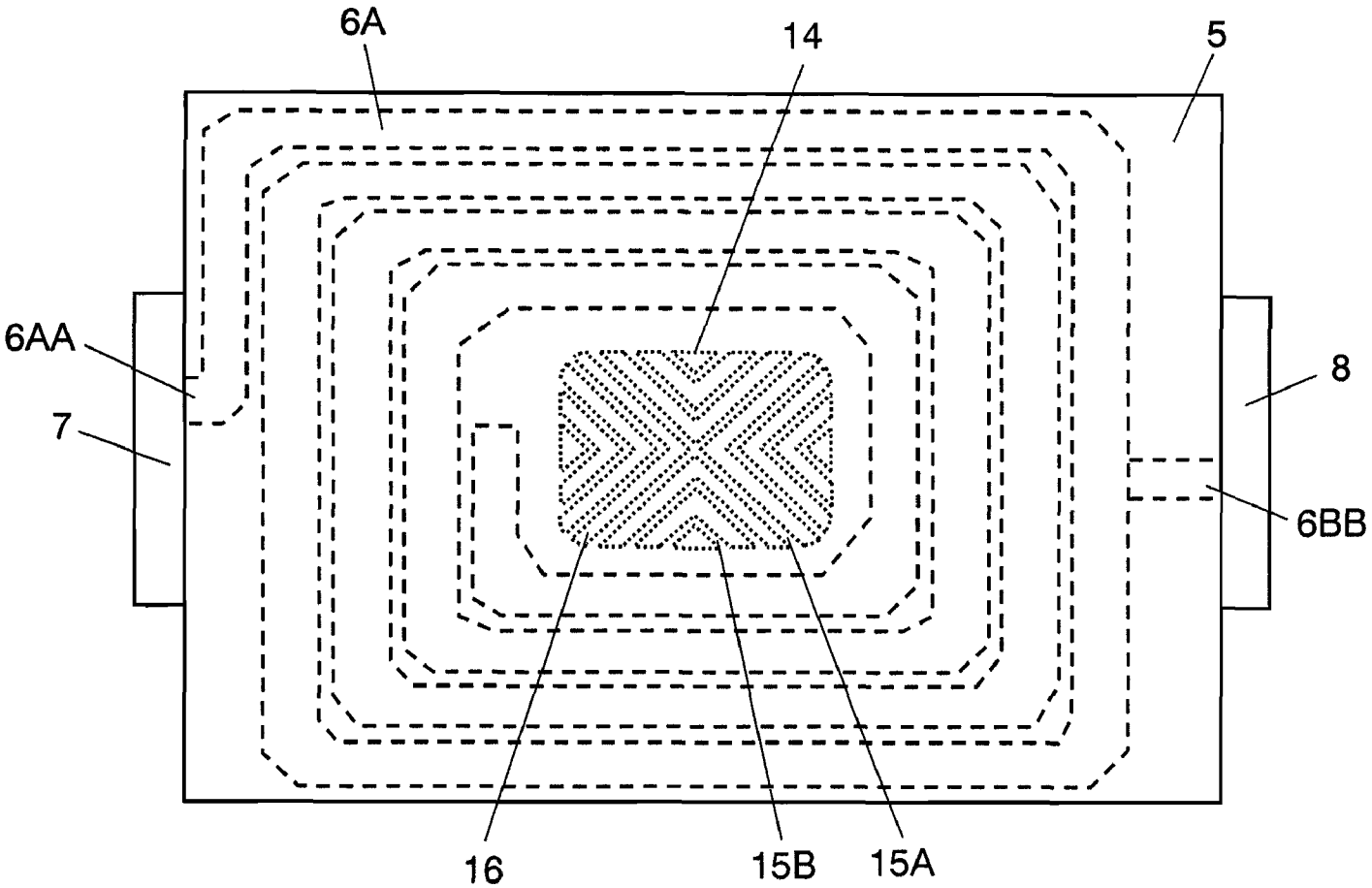
FIG. 19 is a top view of yet another inductance component according to the seventh embodiment of the present invention.

Further, by configuring as shown in FIG. 19, that is, by configuring such that the plurality of substantially V-shaped walls 15B are arranged in parallel to substantially cross-shaped wall 15A and substantially V-shaped magnetic layer 16 is provided between the plurality of substantially V-shaped walls 15B, and between the plurality of substantially V-shaped walls 15B and substantially cross-shaped wall 15A, the eddy current in the central portion in substantially cross-shaped magnetic layer 16A shown in FIG. 18 can be reduced.

Figure 20:
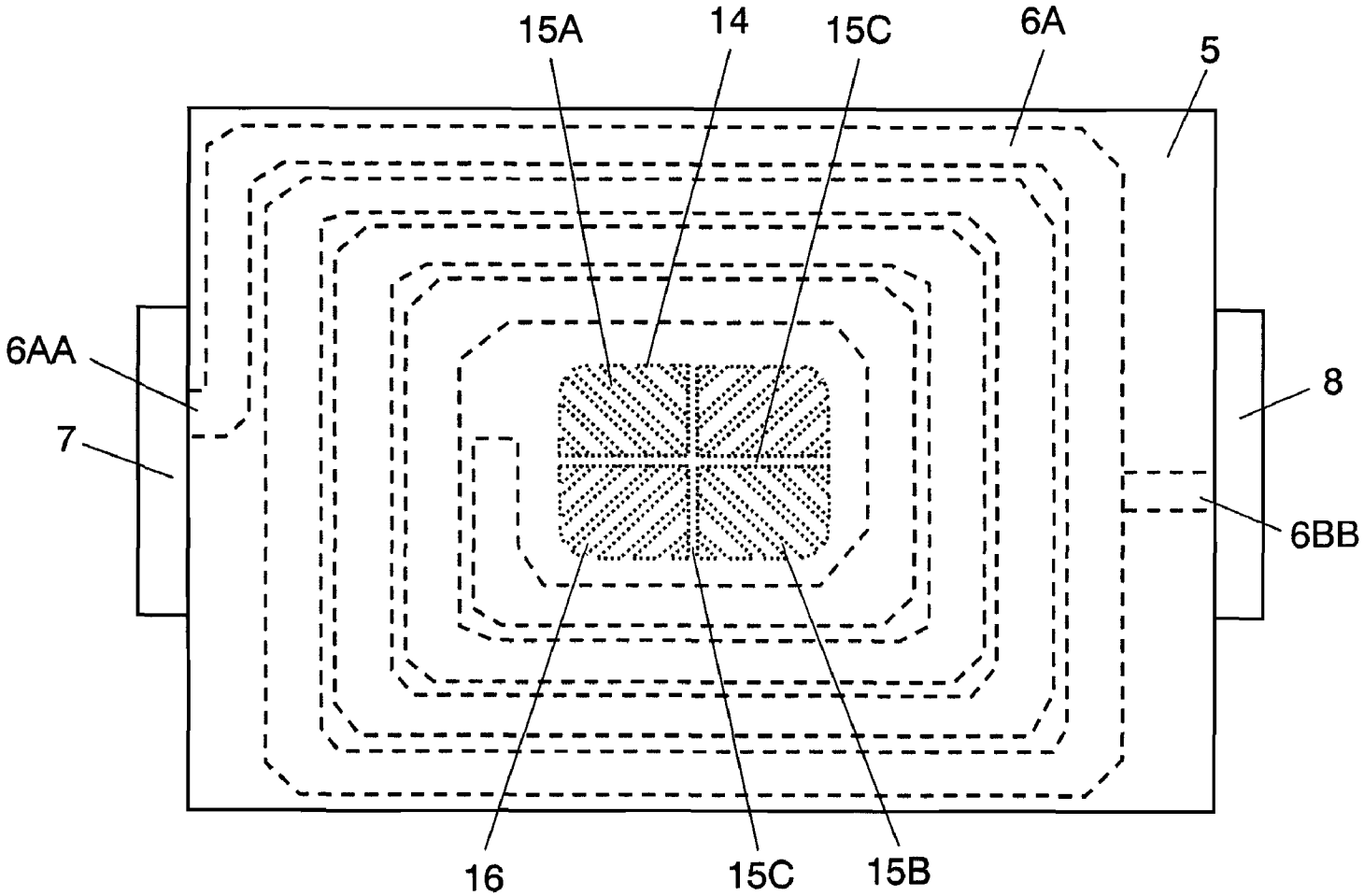
FIG. 20 is a top view of yet another inductance component according to the seventh embodiment of the present invention.

Further, by configuring as shown in FIG. 20, that is, by configuring such that the plurality of substantially V-shaped walls 15B are arranged in parallel to substantially cross-shaped wall 15A, and substantially V-shaped magnetic layer 16 is provided between the plurality of substantially V-shaped walls 15B and between the plurality of substantially V-shaped walls 15B and substantially cross-shaped wall 15A, and at the same time, wall 15C, which intersects the central portion of the plurality of substantially V-shaped walls 15B, is provided therebetween, the eddy current in the central portion in substantially V-shaped magnetic layer 16 as shown in FIG. 19 may be reduced.

Figure 21:
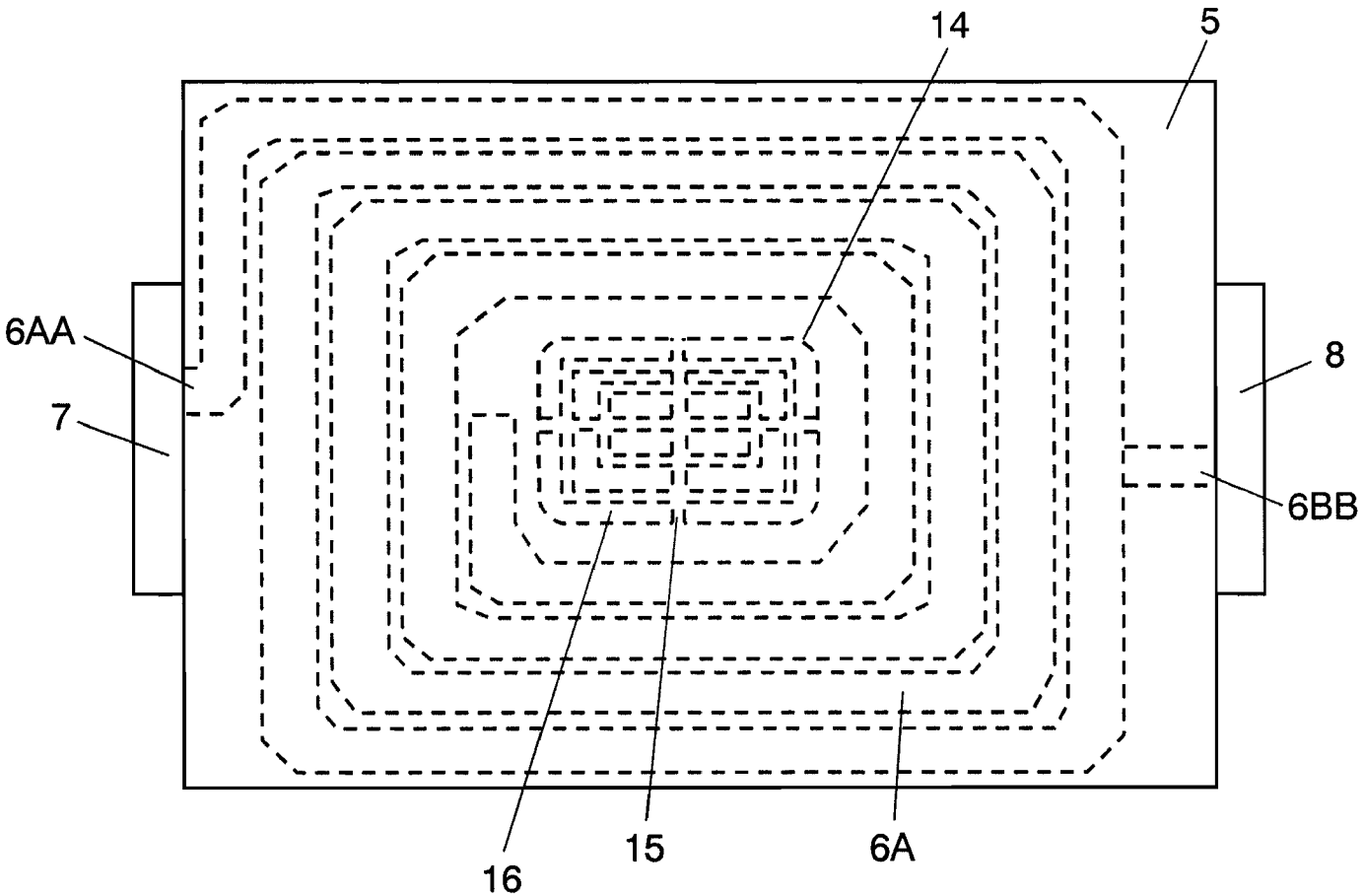
FIG. 21 is a top view of yet another inductance component according to the seventh embodiment of the present invention.
Figure 22:
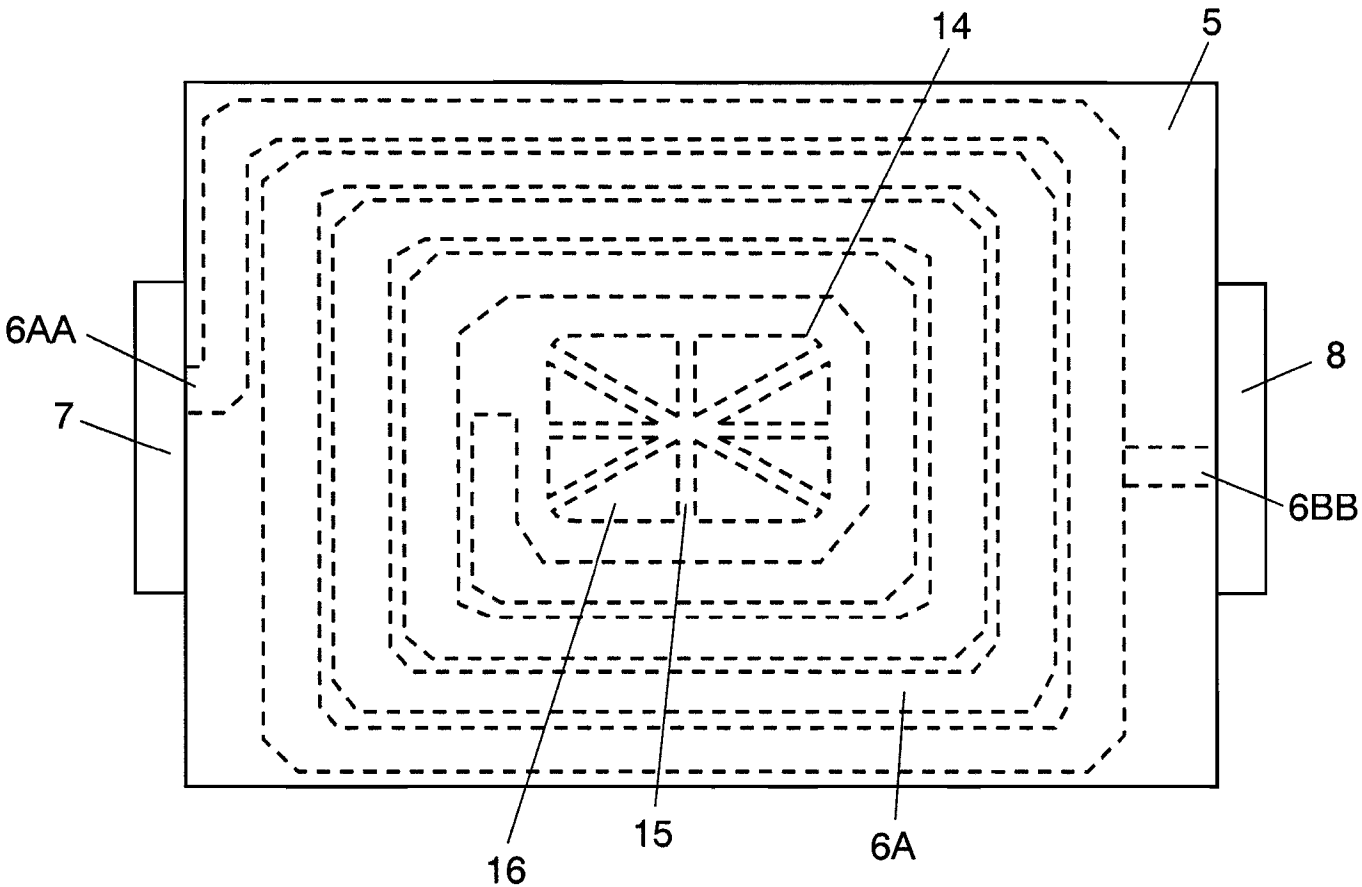
FIG. 22 is a top view of yet another inductance component according to the seventh embodiment of the present invention.
Figure 23:
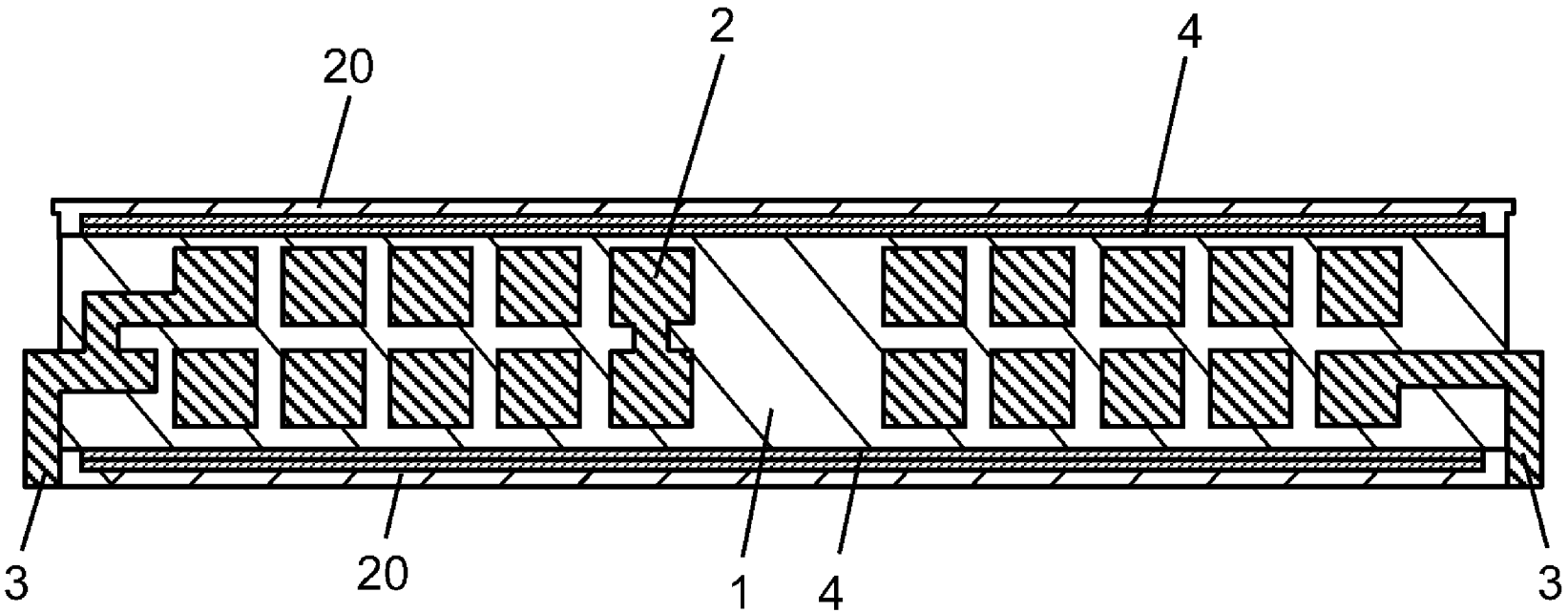
FIG. 23 PRIOR ART
FIG. 23 is a cross-sectional view of the conventional inductance component.

Additionally, by configuring as shown in FIGS. 21 and 22, that is, by configuring such that magnetic layer 16 is formed such that not only the inner peripheral surface of through-hole portion 14 but also the inner side thereof are filled therewith, the generation of the eddy current is further reduced without lowering the magnetic permeability of magnetic layer 16 itself, as in the configuration shown in FIGS. 15 and 17, and at the same time, the effective cross-sectional area of magnetic layer 16 can be increased, and the saturation magnetic flux density may be improved.

However, when walls 15 are arranged so as to emanate from the central portion when seen from a direction perpendicular to the winding surface of coil 6, as shown in FIG. 22, a space between one wall 15 and another wall 15 becomes large on the outer peripheral portion, so that the eddy current is easily generated on the portion. Therefore, it is preferable to configure such that the space between one wall 15 and another wall 15 is substantially constant as shown in FIGS. 15 and 17 to 21, because the generation of the eddy current is reduced more efficiently. For example, in a frequency domain of 1 to 10 MHz, the effect becomes better when the space is made not larger than 20 μm.

Meanwhile, in the present embodiment, it is configured that through-hole portion 14 is formed inside element 5 and through-hole portion 14 is filled with magnetic layer 16. However, when it is configured such that through-hole portion 14 is a through-hole and magnetic layer 16 is continuously formed from the upper and lower surfaces of element 5, leaking magnetic flux may be reduced.

An inductance component according to the present invention is characteristic in that this is highly reliable and an inductance value thereof is high, and is applicable in various electrical instruments such as a cellular phone.

The invention claimed is:

1. An inductance component comprising:

an element including a material having a uniform thermal expansion and contraction rate;

a coil disposed in said element, and wound in a winding surface;

a terminal electrically connected to said coil; and a magnetic layer disposed in said element, said magnetic layer being arranged substantially in parallel to said winding surface of said coil, wherein said magnetic layer is entirely covered with said element, such that said magnetic layer contacts and is entirely covered with said material having a uniform thermal expansion and contraction rate, wherein a slit is formed on said magnetic layer, and said slit is filled with a portion of said element, and wherein said slit is substantially in a V-shape, and said slit is one of a plurality of slits spread in parallel to one another from a bending portion of said substantially V-shape in an outer peripheral direction of said magnetic layer.

2. The inductance component according to claim 1, wherein said magnetic layer is one of a plurality of magnetic layers disposed in said element and a portion of said element is interposed between said plurality of magnetic layers.

3. The inductance component according to claim 2, wherein a thickness of said magnetic layer is less than twice a skin depth.

4. The inductance component according to claim 1, wherein at least a portion of said terminal is formed of a magnetic body.

5. The inductance component according to claim 1, wherein a space between said slits is less than twice a skin depth.

6. The inductance component according to claim 1, wherein said bending portion of said substantially V-shaped slit is formed at a position corresponding to a central portion of said coil in said magnetic layer.

7. The inductance component according to claim 1, wherein said slit is one of a plurality of slits and said plurality of slits includes a slit in a substantially cross-shape and a slit in a substantially V-shape, said substantially V-shaped slit is arranged in parallel to said substantially cross-shaped slit, and said substantially V-shaped slit is one of a plurality of substantially V-shaped slits spread in parallel to one another from a bending portion of said substantially V-shape in an outer peripheral direction of said magnetic layer.

8. The inductance component according to claim 7, wherein a space between said plurality of substantially V-shaped slits is less than twice a skin depth.

9. The inductance component according to claim 1, wherein said slit is a substantially V-shaped slit formed at least on an inner square portion of said magnetic layer, and said substantially V-shaped slit is one of a plurality of substantially V-shaped slits spread in parallel to one another from a bending portion of said substantially V-shape in an outer peripheral direction of said magnetic layer.

10. The inductance component according to claim 9, wherein a radial slit extending from a central direction to the outer peripheral direction of said magnetic layer is further formed on an outer square portion of said magnetic layer.

11. The inductance component according to claim 10, wherein one end of said substantially V-shaped slit and one end of said radial slit are connected to each other.

12. The inductance component according to claim 9, wherein an outer core made of a magnetic material is disposed on an outer side of said coil in said element, and one end of said substantially V-shaped slit is formed to extend up to a portion of said outer core.

13. The inductance component according to claim 1, wherein a through-hole portion is disposed in said element inside said coil and a magnetic layer is formed within said through-hole portion, and an insulating wall substantially perpendicular to said winding surface of said coil is disposed on said magnetic layer.

14. The inductance component according to claim 1, wherein said magnetic layer entirely faces said coil across said element.

15. An inductance component comprising:

an element including a material having a uniform thermal expansion and contraction rate;

a coil disposed in said element, and having an upper side and a lower side;

a terminal electrically connected to said coil; and a magnetic layer disposed on either of said upper side and said lower side of said coil, wherein a plurality of substantially V-shaped slits is formed on said magnetic layer, wherein said coil is wound in a winding surface, said magnetic layer is disposed in said element, and arranged substantially in parallel to said winding surface of said coil, said slits are spread in parallel to one another from a bending portion thereof in an outer peripheral direction of said magnetic layer, and said magnetic layer is entirely covered with said element, such that said magnetic layer contacts and is entirely covered with said material having a uniform thermal expansion and contraction rate.

16. The inductance component according to claim 15, wherein a substantially cross-shaped slit is formed on said magnetic layer, and said substantially V-shaped slits are arranged in parallel to said substantially cross-shaped slit.

17. The inductance component according to claim 15, wherein said magnetic layer is arranged substantially in parallel to a winding surface of said coil, and said magnetic layer entirely faces said coil across said element.

18. The inductance component according to claim 16, wherein a radial slit extending from a central direction in the outer peripheral direction of said magnetic layer is formed on an outer square portion of said magnetic layer.

19. The inductance component according to claim 18, wherein one end of at least one of said substantially V-shaped slits and one end of said radial slit are connected to each other.

20. An inductance component comprising:

an element including a material having a uniform thermal expansion and contraction rate;

a coil disposed in said element, and having an upper side and a lower side;

a terminal electrically connected to said coil; and a magnetic layer having an inner square portion, and being disposed on at least one of said upper side and said lower side of said coil, wherein said coil is wound in a winding surface, said magnetic layer is disposed in said element, and arranged substantially in parallel to said winding surface of said coil, a plurality of substantially V-shaped slits is formed at least on said inner square portion of said magnetic layer, each of said V-shaped slits having a bending portion said slits are spread in parallel to one another from a bending portion thereof in an outer peripheral direction of said magnetic layer, and said magnetic layer is entirely covered with said element, such that said magnetic layer contacts and is entirely covered with said material having a uniform thermal expansion and contraction rate.

21. The inductance component according to claim 20, wherein an outer core made of a magnetic material is disposed on an outer portion of said coil in said element, and one end of at least one of said substantially V-shaped slits is formed to extend up to a portion of said outer core.

22. The inductance component according to claim 20, wherein said magnetic layer is arranged substantially in parallel to a winding surface of said coil, and said magnetic layer entirely faces said coil across said element.

* * * * *